US012179811B2

(12) United States Patent
Gachhadar et al.

(10) Patent No.: US 12,179,811 B2
(45) Date of Patent: Dec. 31, 2024

(54) MODULAR COIL RAILCAR

(71) Applicant: TrinityRail Products and Services, LLC, Dallas, TX (US)

(72) Inventors: Suman Gachhadar, Frisco, TX (US); Christopher Crisafulli, Mansfield, TX (US); Aubra D. McKisic, Flower Mound, TX (US); Konstantin I. Khenokh, Plano, TX (US)

(73) Assignee: TRINITY RAIL GROUP, LLC, Dallas, TX (US)

( * ) Notice: Subject to any disclaimer, the term of this patent is extended or adjusted under 35 U.S.C. 154(b) by 891 days.

(21) Appl. No.: 17/181,852

(22) Filed: Feb. 22, 2021

(65) Prior Publication Data

US 2021/0261172 A1 Aug. 26, 2021

Related U.S. Application Data

(60) Provisional application No. 62/979,162, filed on Feb. 20, 2020.

(51) Int. Cl.
*B61D 3/04* (2006.01)
*B61D 3/16* (2006.01)

(52) U.S. Cl.
CPC ..... *B61D 3/04* (2013.01); *B61D 3/16* (2013.01)

(58) Field of Classification Search
CPC ..... B61D 3/04; B61D 3/16
See application file for complete search history.

(56) References Cited

U.S. PATENT DOCUMENTS 9,387,864 B2 7/2016 Lydic et al.
2017/0217450 A1* 8/2017 Thompson ..... B61D 45/003
2021/0001898 A1 1/2021 Huck

FOREIGN PATENT DOCUMENTS

CN 201890231 U 7/2011

OTHER PUBLICATIONS

Office Action issued by the Canadian Intellectual Property Office for Application No. 3,109,815—Feb. 14, 2024.

* cited by examiner

*Primary Examiner* — Robert J McCarry, Jr.
(74) *Attorney, Agent, or Firm* — Baker Botts L.L.P.

(57) ABSTRACT

A modular railcar includes a modular top system that is configured to hold one or more coils of material, and a railcar underframe that supports the modular top system. The modular top system includes a pair of side sills and one or more troughs disposed between the pair of side sills. Each side sill of the pair of side sills extends a longitudinal length of the modular top system. Each trough of the one or more troughs is configured to hold a coil of the one or more coils of material. The underframe includes one or more coupling apparatuses that are configured to detachably engage the modular top system when the modular top system is positioned on top of the underframe.

18 Claims, 15 Drawing Sheets

MODULAR COIL RAILCAR

RELATED APPLICATIONS

This application claims priority to U.S. Provisional Application Ser. No. 62/979,162 entitled "MODULAR COIL RAILCAR," filed Feb. 20, 2020, the entire content of which is incorporated herein by reference.

TECHNICAL FIELD OF THE INVENTION

This disclosure relates generally to railcars, and more particularly to a modular coil railcar.

BACKGROUND

Railcars designed specifically to transport coils of material are known as coil railcars. Coil railcars are typically designed either to transport coils of material positioned with their axes of rotation parallel to the longitudinal axis of the railcar, or to transport coils of material positioned with their axes of rotation perpendicular to the longitudinal axis of the railcar. While coil cars typically transport coils of sheet metal, such as steel or aluminum, they may be used to transport any type of coiled material, including plastic.

SUMMARY

According to an embodiment, a modular railcar includes a modular top system that is configured to hold one or more coils of material, and a railcar underframe that supports the modular top system. The modular top system includes a pair of side sills and one or more troughs disposed between the pair of side sills. Each side sill of the pair of side sills extends a longitudinal length of the modular top system. Each trough of the one or more troughs is configured to hold a coil of the one or more coils of material. The underframe includes one or more coupling apparatuses that are configured to detachably engage the modular top system when the modular top system is positioned on top of the underframe.

According to another embodiment, a method includes removing a first modular top system that is configured to hold one or more coils of material from a railcar underframe. The first modular top system includes a pair of side sills and one or more troughs disposed between the pair of side sills. Each side sill of the pair of side sills extends along a longitudinal length of the first modular top system. Each trough of the one or more troughs is configured to hold a coil of the one or more coils of material. The railcar underframe includes one or more coupling apparatuses that are configured to detachably engage the first modular top system. Removing the first modular top system from the railcar underframe includes disengaging the first modular top system from the one or more coupling apparatuses of the railcar underframe. The method also includes placing a second modular top system on the railcar underframe. The one or more coupling apparatuses of the railcar underframe are further configured to detachably engage the second modular top system. Placing the second modular top system on the railcar underframe includes engaging the second modular top system with the one or more coupling apparatuses of the railcar underframe.

According to a further embodiment, a modular top system that is configured to hold one or more coils of material includes a pair of side sills, one or more troughs disposed between the pair of side sills, and one or more coupling apparatuses configured to detachably couple to a railcar underframe. Each trough of the one or more troughs is configured to hold a coil of the one or more coils of material.

Certain embodiments of the modular coil railcar provide one or more technical advantages. For example, an embodiment transfers coil loads to the middle of the railcar and into the center sill rather than the side sills, thereby enabling the modular coil car to use shorter side sills and/or side sills of alternate designs (e.g., scalloped), as compared with conventional coil railcars. The use of such side sills may improve the efficiency of the coil loading and unloading processes, by permitting unencumbered access to the central axes of the coils during these processes. Additionally, the use of shorter and/or scalloped side sills may lead to an overall weight reduction, as compared with conventional coil railcars, thereby improving the efficiency of coil transport by rail. As another example, an embodiment enables a modular top system that is configured to transport coils to be easily replaced with a modular top system of another design, thereby changing the railcar from a coil railcar into a railcar of another type. In this manner, use of the railcar may be maximized, despite changing market conditions. Certain embodiments may include none, some, or all of the above technical advantages. One or more other technical advantages may be readily apparent to one skilled in the art from the figures, descriptions, and example embodiments included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
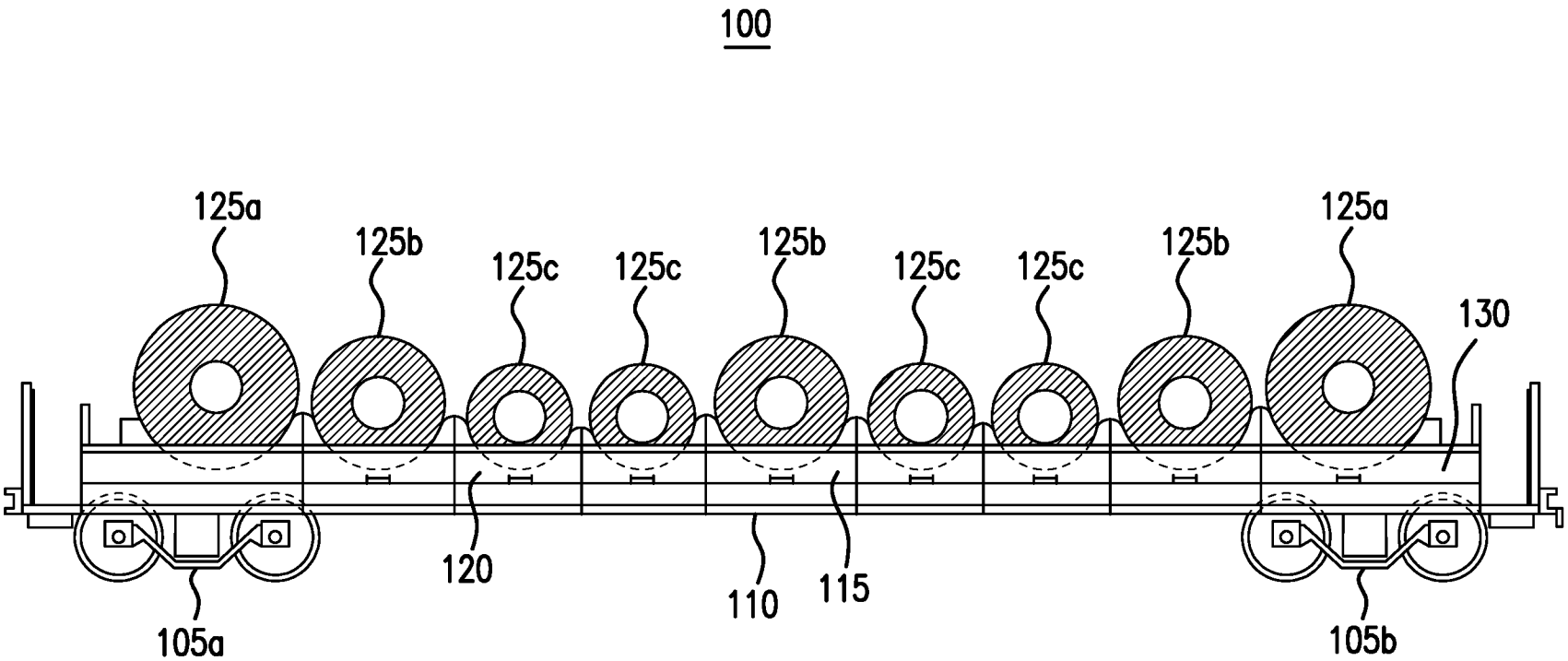
FIG. 1 illustrates a conventional transverse coil car.

Railcars designed specifically to transport coils of material are known as coil railcars. While coil railcars are typically considered a sub-type of gondola railcars, they are generally much more specialized. For example, while gondola railcars may transport a wide variety of different materials in different forms, such as gravel aggregate or scrap metal, coil cars are designed either as longitudinal coil cars, configured to transport coils of material positioned with their axes of rotation parallel to the longitudinal axis of the railcar, or as transverse coil cars, configured to transport coils of material positioned with their axes of rotation perpendicular to the longitudinal axis of the railcar. Both longitudinal and transverse coil cars transport coils positioned in one or more troughs. This helps to prevent the coils from rolling while the railcars are in motion. While coil cars typically transport coils of sheet metal, such as steel or aluminum, they may be used to transport any type of coiled material, including plastic.

In conventional transverse coil railcars, the troughs that support the coils are attached to the side sills of the railcars. This results in a transfer of the vertical weight of the coils, as well as lateral and longitudinal reaction loads from the coils, to the side sills. Accordingly, the side sills of conventional transverse coil cars are relatively large in order to withstand such loads and transfer them to the underframe of the railcar. However, when small coils are loaded into the troughs of such coil cars, the large side sills may obscure all or part of the area from which the coils are to be lifted, making it difficult to unload the coils from the railcar.

Another issue with conventional coil cars relates to the fact that such cars are specifically built as either longitudinal coil cars or transverse coil cars and generally cannot be adapted for other purposes. Accordingly, any decrease in the demand for a particular type of coil car, or a decrease in the demand for coil transport by rail, in general, may result in coil railcars being taken out of service prematurely. This may lead to significant inefficiency and waste, given that a large portion of the railcar (for example, the truck assemblies, underframe, and braking system) may remain useable for purposes other than longitudinal and/or transverse coil transport.

This disclosure contemplates a modular coil railcar that addresses one or more of the above issues. Certain embodiments of the modular coil car include a common underframe that may be coupled to a plurality of different top portions. For example, this disclosure contemplates that the common underframe may be coupled to a modular top configured to transport coils transversely and/or a modular top configured to transport coils longitudinally. The use of such a modular top portion offers several advantages over conventional coil cars. As an example, in contrast to conventional transverse coil cars, the modular transverse coil car top of the present disclosure is designed to transfer a majority of the vertical coil loads into the underframe, rather than the side sills of the car. This allows the side sills of the modular railcar to be smaller than those of conventional transverse coil cars, providing unencumbered access to any loaded coils, thereby enabling easy loading and/or unloading. As another example, the modular top may easily be decoupled from the common underframe and replaced with a different top, of a different design and/or for a different purpose. For example, the common underframe be coupled to a modular top configured to transport coils transversely, a modular top configured to transport coils longitudinally, and/or a modular top configured for an entirely different purpose than transporting coils. By enabling one modular top to be swapped for another, the modular coil car may easily adapt to changing market conditions, avoiding the waste associated with otherwise taking the car out of service.

Embodiments of the present disclosure and its advantages are best understood by referring to FIGS. 1 through 14 of the drawings, like numerals being used for like and corresponding parts of the various drawings.

FIG. 1 is a schematic side view of a conventional transverse coil railcar 100. Railcar 100 includes open top 115, which is supported by truck assemblies 105*a* and 105*b*. Open top 115 includes underframe 110 and side sills 130. As illustrated in FIG. 1, open top 115 includes nine transverse troughs 120 that are each configured to transport a coil 125 positioned such that the axis of rotation of coil 125 is perpendicular to the longitudinal axis of railcar 100. Conventional transverse coil railcars may be configured to transport coils 125 of various diameters. For example, as illustrated in FIG. 1, railcar 100 is configured to transport large coils 125*a*, medium coils 125*b*, and smaller coils 125*c*. In some conventional transverse coil cars 100, coils 125 of different diameters may be transported within troughs 120 of the same width, because the coils 125 are supported by the sides of troughs 120 (rather than resting on the bottom of troughs 120). Accordingly, in such transverse coil cars, large diameter coils 125*a* will rest higher up in troughs 120 than small diameter coils 125*c*.

In conventional transverse coil cars 100, troughs 120 are attached to side sills 130. Accordingly, both the vertical weight of coils 125, as well as the lateral and longitudinal reaction loads experience by coils 125, are transferred from coils 125 to side sills 130. As a result, side sills 130 on conventional transverse coil cars 100 are typically quite large, in order to withstand such loads and transfer them to underframe 110 of railcar 100. When coils 125 of different diameters are transported within fixed-width troughs 120, the large side sills 130, which are present to withstand and transfer the loads from coils 125, may lead to issues when loading and unloading railcar 100. For example, because troughs 120 are fixed-width, when smaller coils 125*c* are loaded into top 115, the center of these coils is lower with respect to side sills 130 than the center of larger coils 125*a*. As a result, on some transverse coil railcars 100, side sills 130 may cover all or a portion of the centers of smaller coils 125*c*. Given that coils 125 are typically handled at their centers, this may make loading and unloading smaller coils 125*c* difficult.

Additionally, because open top 115 is integrally connected to underframe 110 and truck assemblies 105*a* and 105*b*, any change in market conditions may lead a rail operator to take the entire railcar 100 out of service, if the design of railcar 100 is no longer efficient for the current conditions. However, given that many parts of railcar 100— including truck assemblies 105*a* and 105*b*, underframe 110, and other components of the railcar, such as brake systems—may be common amongst other types of railcars (e.g., boxcars, flatcars, gondola cars, etc.), removing the entire railcar 100 from service simply because top portion 115 does not match current market demand may result in considerable inefficiency and waste.

This disclosure contemplates a modular coil railcar that addresses one or more of the above issues. Certain embodiments of the modular coil car include a modular coil car top that may be coupled to a common underframe. Some embodiments of the modular coil car top are configured to transport longitudinally aligned coils, and some embodiments are configured to transport transversely aligned coils. In contrast to conventional transverse coil cars 100, the modular transverse coil car top of the present disclosure is designed to transfer a majority of the vertical coil loads into the underframe, rather than the side sills of the car. This allows the side sills of the modular railcar to be smaller than those of conventional transverse coil cars, providing, in certain embodiments, unencumbered access to any loaded coils, thereby enabling easy loading and unloading. Additionally, the modular top may easily be decoupled from the common underframe and replaced with a different top, allowing the railcar to adapt to changing market conditions.

Figure 2A:
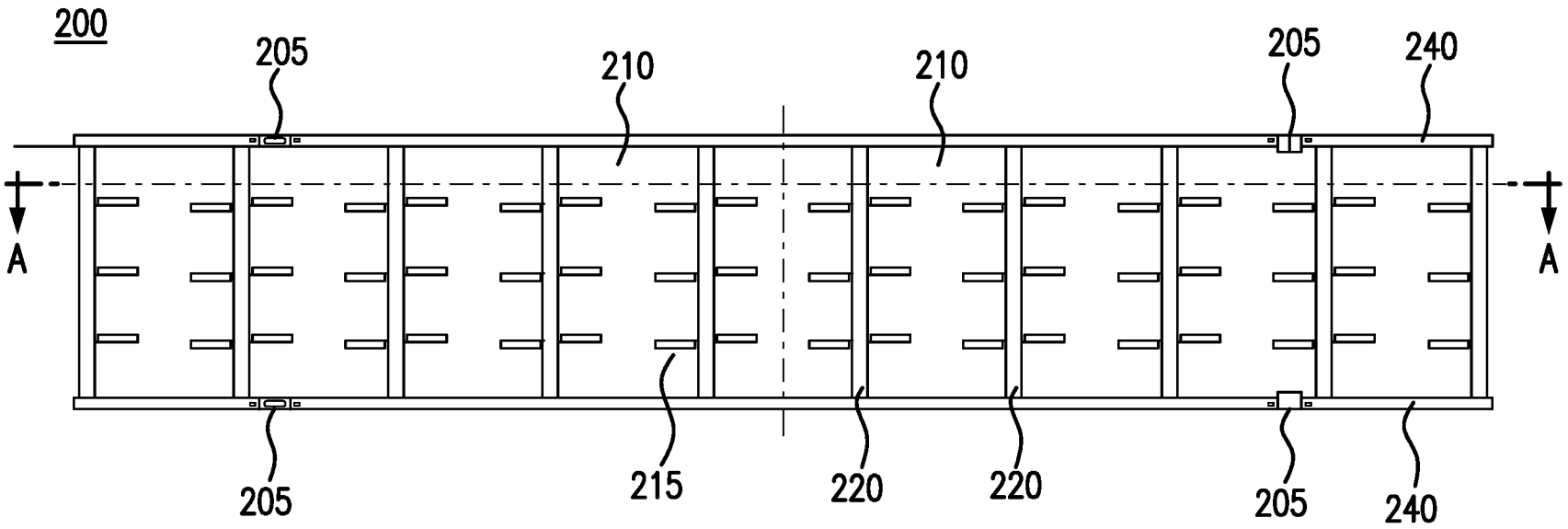
FIGS. 2A and 2B illustrate a bottom-up view and side view, respectively, of an example modular transverse coil car top of the present disclosure.
Figure 2B:
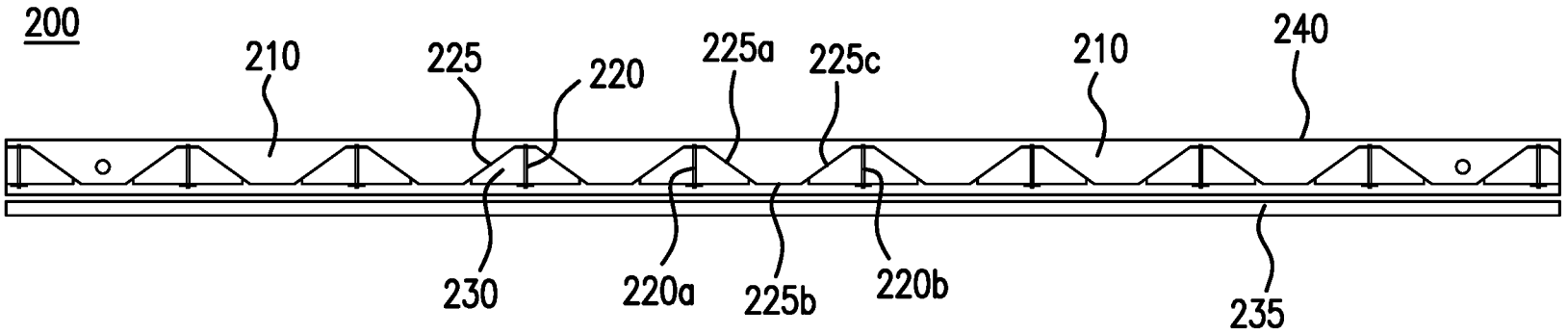
Figure 2C:
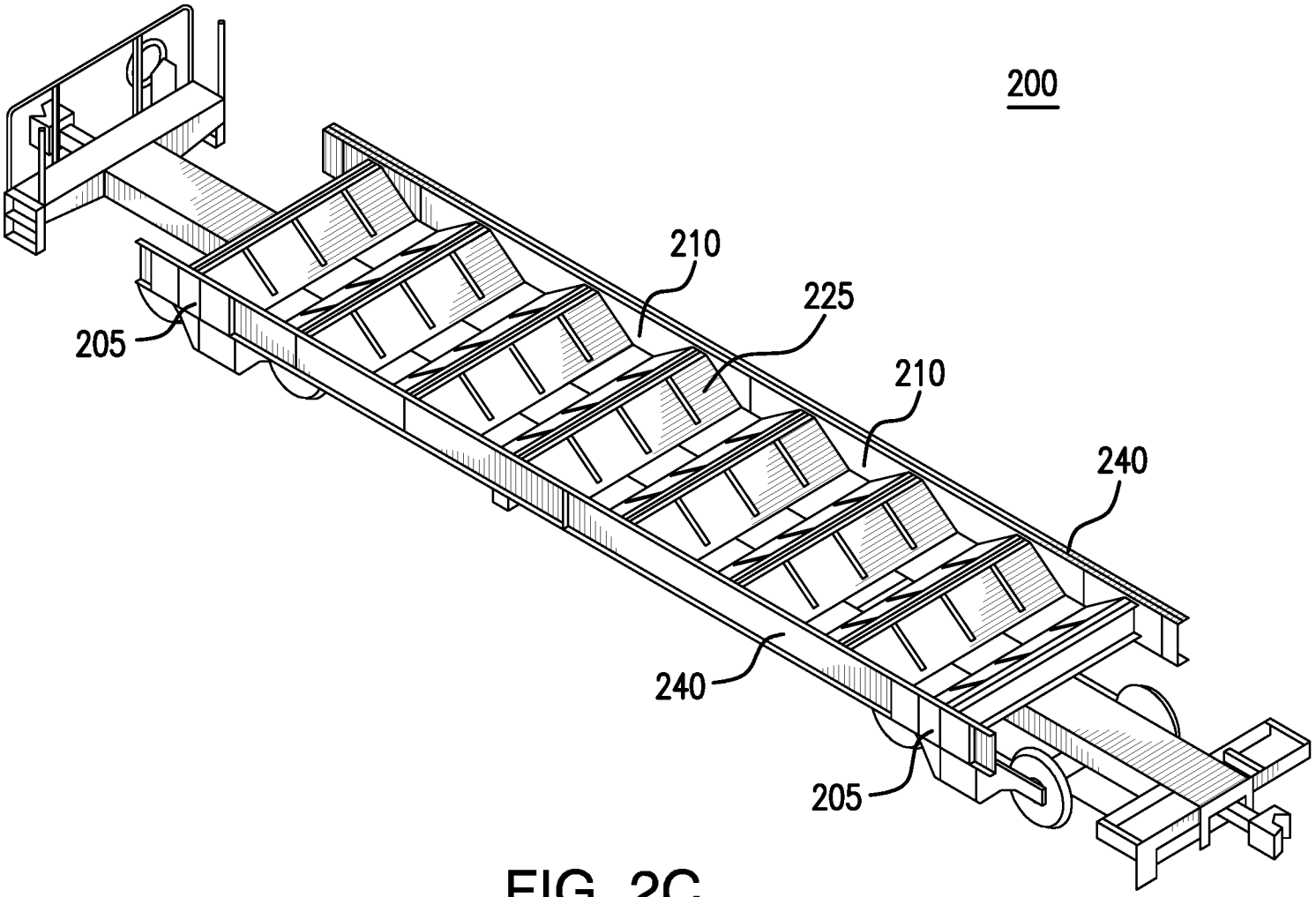
FIGS. 2C and 2D illustrate isometric views of the top and underside, respectively, of an example modular transverse coil car top of the present disclosure.
Figure 2D:
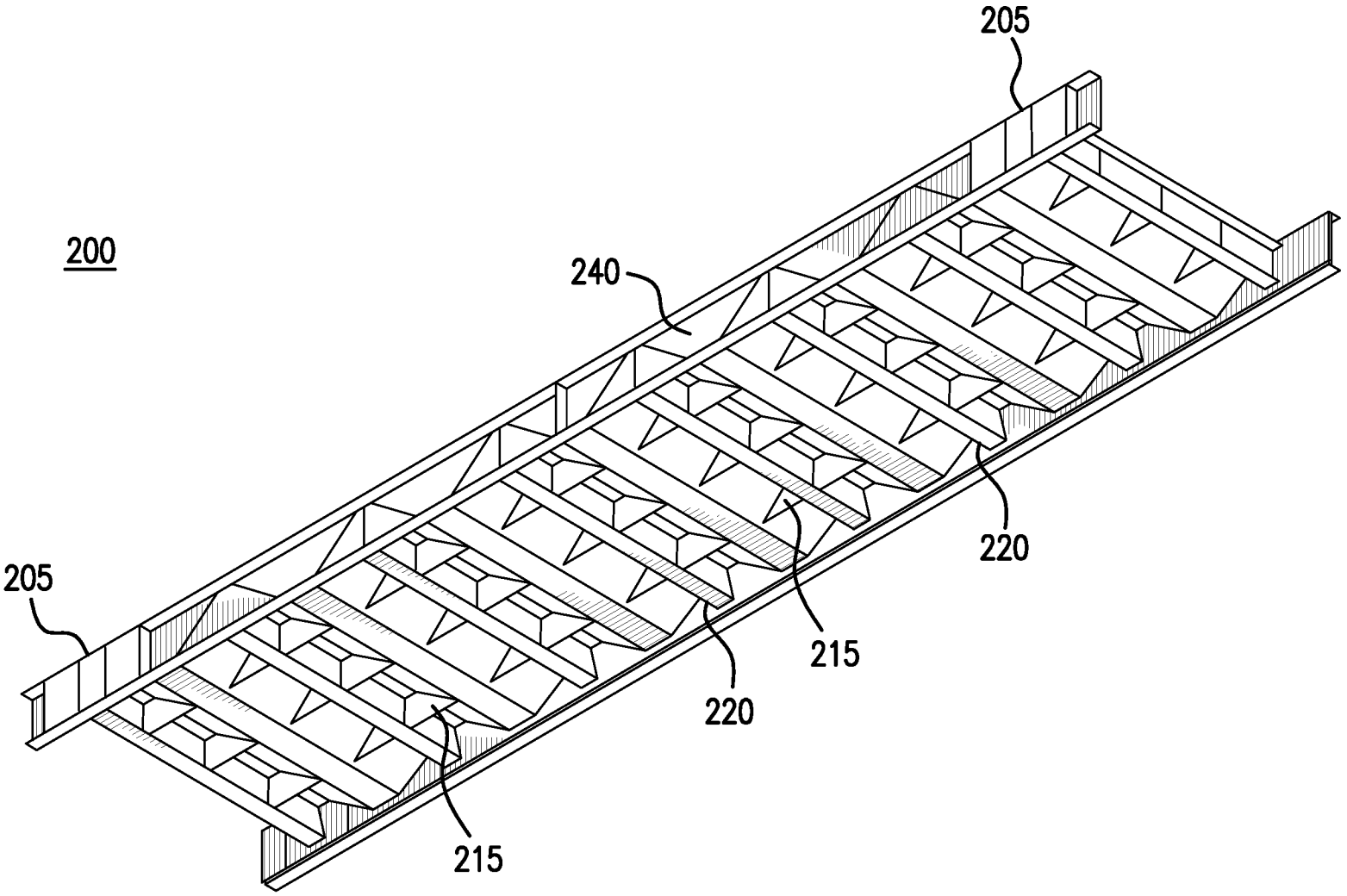

FIGS. 2A through 2D present examples of a modular transverse coil car top 200 of the present disclosure. FIG. 2A illustrates a bottom-up view of a modular coil car top 200 that includes nine troughs 210, FIG. 2B illustrates a side view of a modular coil car top 200 that includes nine troughs 210, FIG. 2C illustrates an isometric view of the top of a modular coil car top 200 that includes seven troughs 210, and FIG. 2D illustrates an isometric view of the underside of a modular coil car top 200 that includes seven troughs 210. As illustrated in FIGS. 2A through 2D, in certain embodiments, modular coil car top 200 includes (1) a plurality of I-beams 220, which extend in a transverse direction between side sills 240, (2) a plurality of gussets 215 coupled to I-beams 220, and (3) a plurality of floor sections 225, supported by I-beams 220 and gussets 215, which define a number of transverse troughs 210. While illustrated in FIGS. 2A and 2B as including nine transverse troughs 210, and in FIGS. 2C and 2D as including 7 transverse troughs 210, this disclosure contemplates that modular coil car top 200 may include any number of troughs 210. For example, a first modular coil car top 200 may include 5 troughs 210, a second modular coil car top 200 may include 7 troughs 210, and a third modular coil car top 200 may include 9 troughs 210. Additionally, while illustrated in FIGS. 2A through 2D as including transverse troughs 210, this disclosure contemplates that modular coil car top 200 may include longitudinal troughs, and/or a mixture of both transverse and longitudinal troughs. An example of a modular longitudinal coil car top is described below, in the discussion of FIGS. 8A and 8B.

In certain embodiments, each trough 210 is formed from an angled floor sheet 225 positioned between a pair of I-beams 220*a* and 220*b*. As illustrated in FIG. 2B, each angled floor sheet 225 includes (1) a first angled portion 225*a*, which slopes downward, away from the top of support member 220*a*, (2) a horizontal portion 225*b*, which defines the lowest position of trough 210, and (3) a second angled portion 225*c*, which slopes upward, toward the top of support member 220*b*. Each angled floor sheet 225 extends in a transverse direction between side sills 240 and may be formed from one or more sheets of metal, as described in further detail below, in the discussion of FIGS. 4A and 4B.

A plurality of gussets 215 are coupled to each I-beam 220. As illustrated in FIGS. 2B and 2D, each gusset 215 may be formed as a metal plate of any suitable thickness. Gussets 215 may be positioned substantially parallel to one another and extend in a direction parallel to the longitudinal axis of modular transverse coil car top 200 (the direction generally perpendicular to support members 220). Gussets 215 are configured to support angled floor sheets 225. Accordingly, a side of each gusset 215 is configured to slope downwards, away from I-beam 220, with angled floor sheet 225 configured to rest on top of this side. This disclosure contemplates that any number of gussets 215 may extend from I-beams 220 to floor sheet 225, on either side of I-beam 220.

While illustrated in FIGS. 2B and 2D, as including I-beams 220, this disclosure contemplates that I-beams 220 may be replaced by any suitable vertical load carry members, which extend in a transverse direction between side sills 240. The use of alternative geometries in place of I-beams 220 is described in further detail below, in the discussion of FIGS. 5 through 7.

Modular coil car top 200 is configured to couple to a common underframe using one or more coupling apparatuses 205, as described in further detail below, in the discussion of FIGS. 9 through 11. Modular coil car top 200 may include any number of coupling apparatuses 205. For example, as illustrated in FIGS. 2A through 2D, modular coil car top 200 may include two pairs of coupling apparatuses 205-*a* first pair of coupling apparatuses 205 located near a first end of modular coil car top 200 and a second pair of coupling apparatuses 205 located near a second end of modular coil car top 200. When coupled to the common underframe, I-beams 220 of modular coil car top 200 are supported by center sill 235 of the common underframe. Because I-beams 220 are located on top of center sill 235, troughs 210 may be located lower on the modular coil railcar than in conventional coil railcars, thereby lowering the overall center of gravity for the loaded car.

In certain embodiments, coils 125 rest in troughs 210 on top of angled floor sheets 225. In particular, coils 125 may rest on angled portions 225*a* and 225*c* of angled floor sheets 225. Angled floor sheets 225 are configured to distribute the loads from coils 125 to gussets 215. Gussets 215 in turn transfer these loads to I-beams 220 and into the common underframe at the center of the railcar and the side sills. In this manner, modular coil car top 200 is configured to transfer a majority of the vertical loads from coils 125 into the common underframe of the modular coil railcar, rather than into side sills 240 (while longitudinal and transverse coil loads transfer to side sills 240, consistent with conventional transverse coil cars). This enables side sills 240 to be smaller than side sills 130 of conventional transverse coil cars. As a result, in certain embodiments, side sills 240 may permit unencumbered access to the centers of small diameter coils 125, facilitating loading and unloading of the coils from modular coil car top 200.

Figure 3:
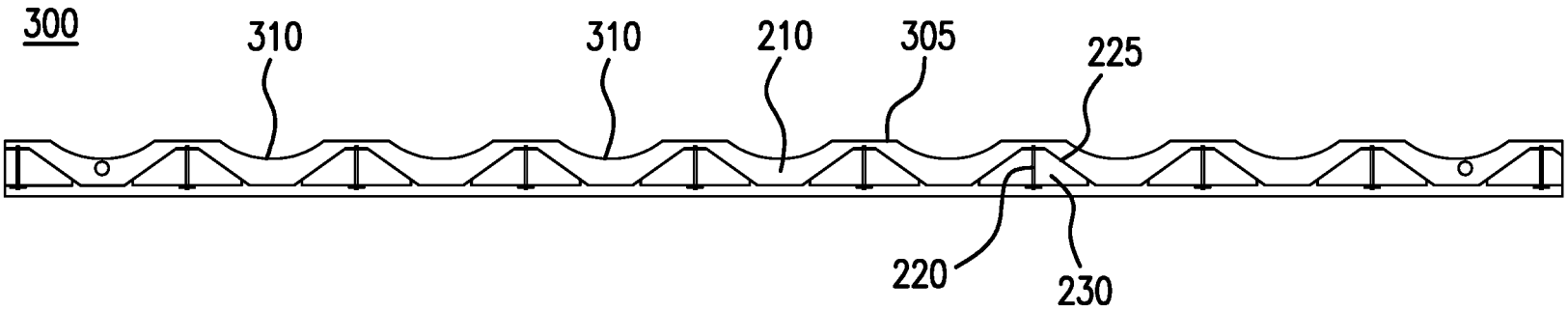
FIG. 3 illustrates a side view of an example modular coil car top that includes scalloped side walls.

As an example, FIG. 3 illustrates a side view of an example modular coil car top 300 that includes scalloped side walls 305 that facilitate loading and unloading of coils 125 from the modular top. As illustrated in FIG. 3, each side wall 305 includes indentations 310 at locations on the side wall adjacent to troughs 210. In certain embodiments, and as illustrated in FIG. 3, indentations 310 may be concave shaped; however, this disclosure contemplates that indentations 310 may be of any suitable shape. In certain embodiments, indentations 310 may provide improved access to coils 125, when loaded in modular coil car top 300. For example, indentations 310 may provide improved access to coils 125 when using a forklift to unload the coils from modular coil car top 300. In some embodiments, indentations 310 may help to reduce the weight of modular coil car top 300.

Figure 4A:
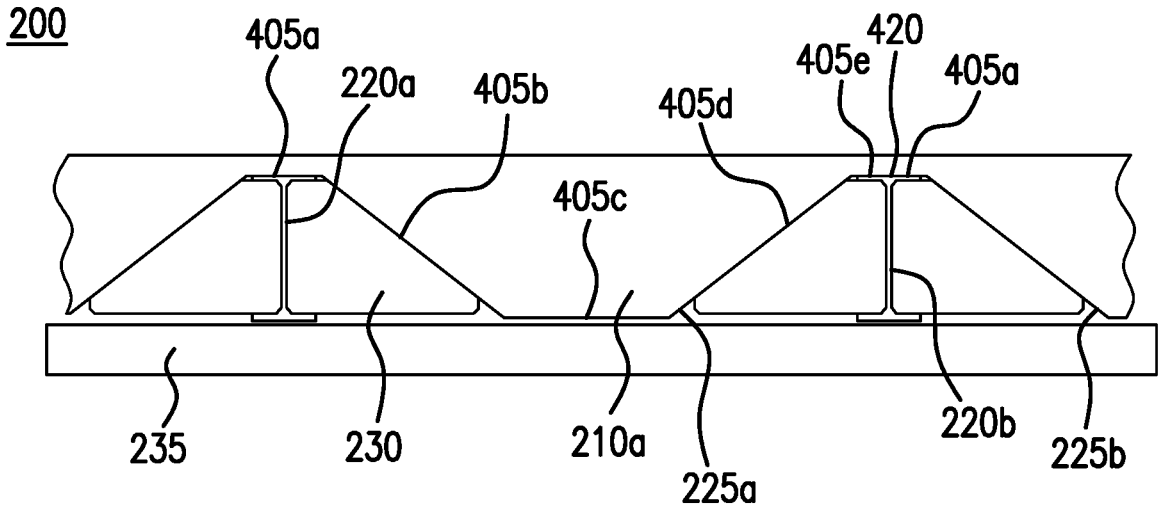
FIGS. 4A and 4B illustrate example constructions of the trough floors of the modular coil car top of the present disclosure.
Figure 4B:
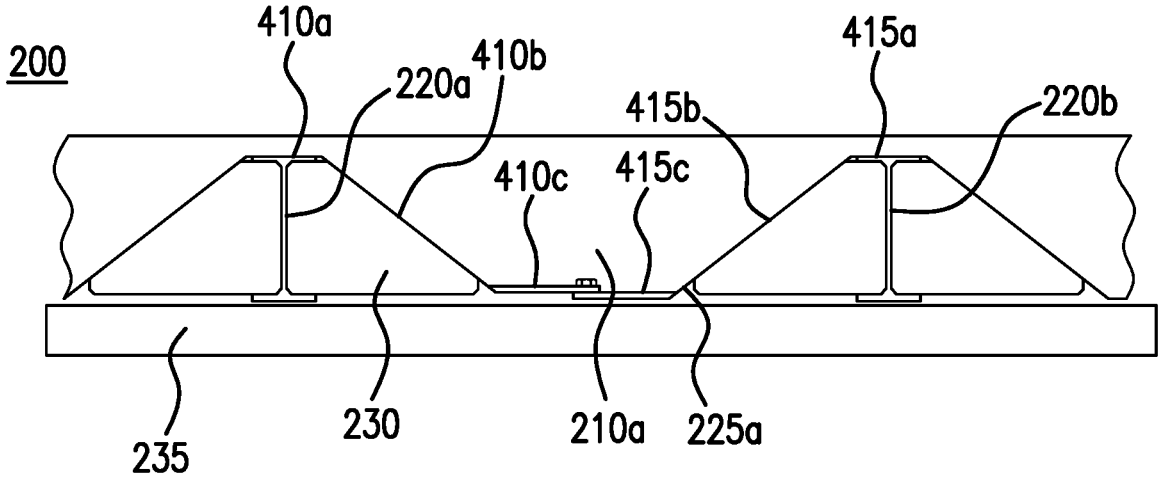

FIGS. 4A and 4B present cross-sections of a trough 210*a* of modular coil car top 200, illustrating example constructions that may be used for the angled floor sheets 225 of troughs 210. FIG. 4A presents an example in which each angled floor sheet 225 of trough 210*a* is formed from a single sheet of metal, while FIG. 4B presents an example in which each angled floor sheets 225 of trough 210*a* is formed from two sheets of metal.

As illustrated in FIG. 4A, in certain embodiments, the angled floor sheet 225, defining a given trough 210, may be formed from a single sheet of metal 405. FIG. 4A presents a cross-section of this single sheet of metal 405. This disclosure contemplates that each sheet of metal 410 and 415 extends in a transverse direction between side sills 240 from a first side of modular coil car top 200 to a second side of modular coil car top 200, opposite the first side. As illustrated in FIG. 4A, single sheet of metal 405 includes four bends, which define five portions of the sheet of metal: (1) a first horizontal portion 405*a*, which is coupled to the top of I-beam 220*a*, (2) a first angled portion 405*b*, which slopes downward, away from the top of I-beam 220*a*, (3) a second horizontal portion 405*c*, which defines the lowest position of trough 210, (4) a second angled portion 405*d*, which slopes upward, from horizontal portion 405*b* and toward the top of the adjacent I-beam 220*b*, and (5) a third horizontal portion 405*e*, which is coupled to the top of I-beam 220*b*. In certain embodiments, the use of a single sheet of metal 405 to form each trough 210 may be desirable, as it may help to ensure that no debris from under the modular coil railcar can contaminate or damage coils 125 during transport. Sheet of metal 405 may be coupled to the tops of I-beams 220*a* and/or 220*b* in any suitable manner. For example, in certain embodiments, sheet of metal 405 is welded to the tops of I-beams 220*a*

As illustrated in FIG. 4A, the third horizontal portion 405*e* of a first angled floor sheet 225*a* is coupled to the top of the same I-beam 220*b* as the first horizontal portion 405*a* of a second angled floor sheet 225*b*. In certain embodiments, a space 420 separates third horizontal portion 405*e* of first angled floor sheet 225*a* from first horizontal portion 405*a* of second angled floor sheet 225*b*. Space 420 may account for manufacturing tolerances and may allow for adjustment of angular floor sheets 225. This disclosure contemplates that space 420 may be of any suitable size. In certain embodiments, rather than including space 420, third horizontal portion 405*e* of first angled floor sheet 225*a* and first horizontal portion 405*a* of second angled floor sheet 225*b* may overlap one another on top of I-beam 220*b*. In some embodiments, third horizontal portion 405*e* of first angled floor sheet 225*a* may be coupled to first horizontal portion 405*a* of second angled floor sheet 225*b*.

As illustrated in FIG. 4B, in certain embodiments, each angled floor sheet 225, defining each trough 210, may be formed from two sheets of metal-first sheet of metal 410 and second sheet of metal 415. FIG. 4B presents a cross-section of sheets of metal 410 and 415. This disclosure contemplates that each sheet of metal 410 and 415 extends in a transverse direction between side sills 240 from a first side of modular coil car top 200 to a second side of modular coil car top 200, opposite the first side. As illustrated in FIG. 4B, first sheet of metal 410 includes two bends, which define three portions of the sheet of metal: (1) a first horizontal portion 410*a*, which is coupled to the top of I-beam 220*a*, (2) an angled portion 410*b*, which slopes downward, away from the top of I-beam 220*a*, and (3) a second horizontal portion 410*c*, which defines the lowest position of trough 210, and extends part way along the bottom of trough 210. Similarly, second sheet of metal 415 includes two bends, which define three portions of the sheet of metal: (1) a first horizontal portion 415*a*, which is coupled to the top of I-beam 220*b*, (2) an angled portion 415*b*, which slopes downward, away from the top of I-beam 220*b*, and (3) a second horizontal portion 415*c*, which defines the lowest position of trough 210, and extends part way along the bottom of trough 210. Second horizontal portion 410*c* of first sheet of metal 410 and second horizontal portion 415*c* of second sheet of metal 415 define the bottom of trough 210. In certain embodiments, and as illustrated in FIG. 4B, second horizontal portion 410*c* of first sheet of metal 410 and second horizontal portion 415*c* of second sheet of metal 415 overlap one another. In some embodiments, the joint where second horizontal portion 410*c* of first sheet of metal 410 and second horizontal portion 415*c* of second sheet of metal 415 overlap one another may be sealed to prevent unwanted debris from damaging coils 125 during transport. In certain embodiments, the use of two sheets of metal 410 and 415 to form each trough 210 may be desirable to provide a greater ability to account for manufacturing tolerances as compared with the single sheet construction of FIG. 4A and/or to facilitate certain manufacturing processes.

While illustrated in FIGS. 4A and 4B as being formed from either a single sheet of metal 405, or two sheets of metal 410 and 415, this disclosure contemplates that each angled floor sheet 225 of trough 210 may be formed from any number of sheets of metal. As an example, angled floor sheet 225 may be formed from sheets of metal that do not extend the full transverse distance between side sills 240. Additionally, this disclosure contemplates that in certain embodiments, a single sheet of metal may be used to form more than one trough 210. For example, a single sheet of metal may be used to form the floors of a pair of adjacent troughs.

Figure 5:
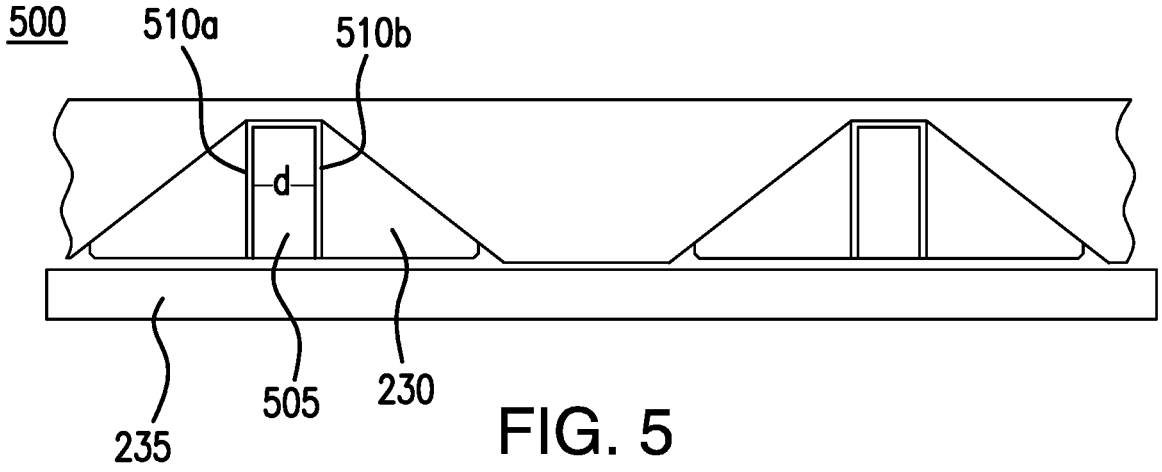
FIG. 5 illustrates an example construction of the modular coil car top of the present disclosure in which the primary vertical load carrying member is a box structure that includes two vertical plates.
Figure 6:
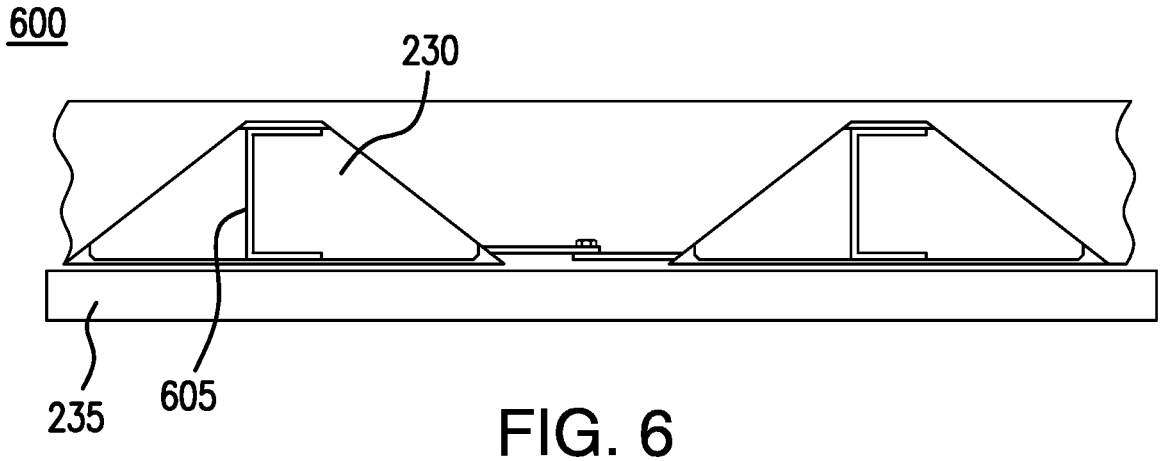
FIG. 6 illustrates an example construction of the modular coil car top of the present disclosure in which the primary vertical load carrying member is a channel.

While FIGS. 2B through 4B illustrate the use of I-beams 220, this disclosure contemplates that any suitable vertical load carrying member configured to span the width between side sills 240 and to transfer vertical coil loads into center sill 235 of the common underframe may be used in place of I-beams 220. For example, FIG. 5 presents an example modular coil car top 500 that includes a box structure 505 for use in place of I-beams 220. As illustrated in FIG. 5, box structure 505 may be defined by a pair of vertical plates 510*a* and 510*b*, separated from one another by a distance d. This disclosure contemplates that d may be any suitable distance. For example, in certain embodiments, d may be the width of a conventional I-beam at its widest extent. Each vertical plate 510*a* and 510*b* is configured to extend in a transverse direction between side sills 240. In certain embodiments, the space between vertical plates 510*a* and 510*b* may be empty. In some embodiments, the space between vertical plates 510*a* and 510*b* may be filled. As another example, FIG. 6 presents an example modular coil car top 600 that includes channels 605 for use in place of I-beams 220. Each channel 605 includes a top portion, a side portion and a bottom portion, such that a cross-section of channel 605 forms a C-shape. Each channel 605 is configured to extend in a transverse direction between side sills 240. In addition to I-beams 220, box structures 505, and channels 605, this disclosure contemplates that any suitable geometry may be used for the vertical load carrying members configured to span the width between side sills 240 and to support angled floor sections 235. The particular geometry chosen for such members may be chosen to maximize the strength of the modular coil car top and/or to achieve various manufacturing advantages.

Figure 7A:
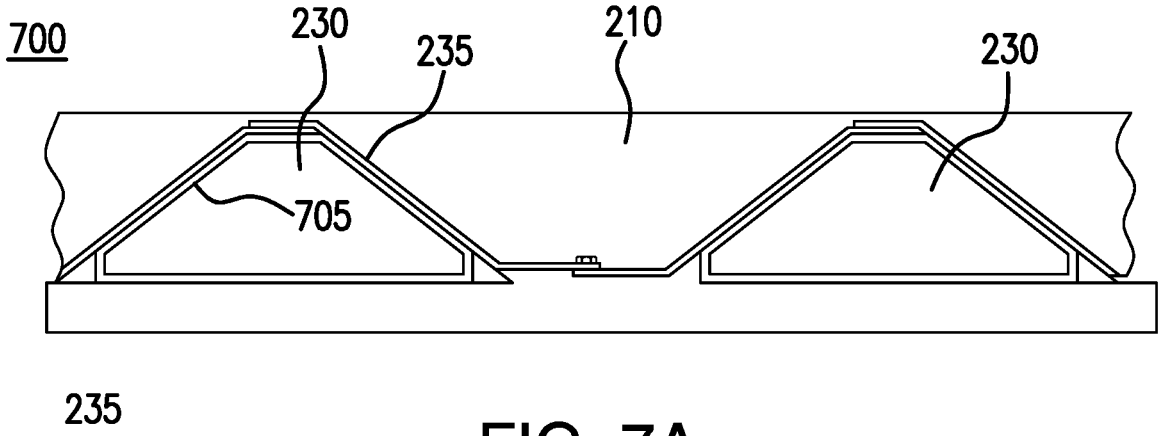
FIGS. 7A through 7C illustrate an example construction of the modular coil car top of the present disclosure in which a monocoque frame structure is the primary vertical load carrying member.
Figure 7B:
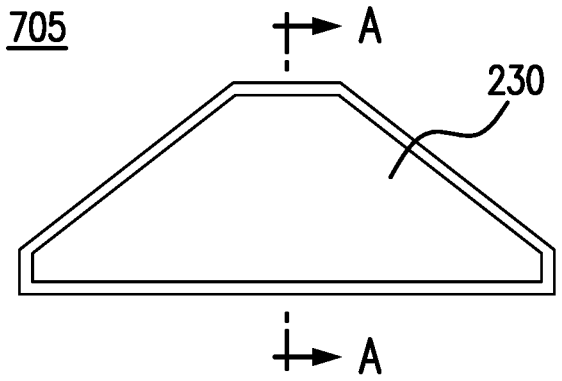
Figure 7C:
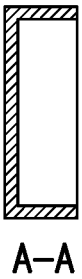

As illustrated in FIGS. 7A through 7C, in certain embodiments, rather than including an integral vertical member, such as an I-beam 220, box structure 505, and/or channel 605, angled floor sections 225 may be supported by monocoque frame structures 705. FIG. 7A illustrates a side view of modular coil car top 700 with monocoque frame structures 705 installed to support angled floor pieces 235, while FIG. 7B illustrates a cross-section of monocoque frame structure 705 prior to installation in modular rail car top 700. A cross-section of monocoque frame structure 705 is generally triangular shaped such that the sloped portions of angled floor pieces 235 are configured to rest against sloped sides of structure 705. A number of gussets 230 may be installed inside monocoque frame structure 705 to provide added support. Gussets 230 may be installed at various spacings within structure 705. FIGS. 7B and 7C illustrate an example geometry for such gussets 230.

Figure 8A:
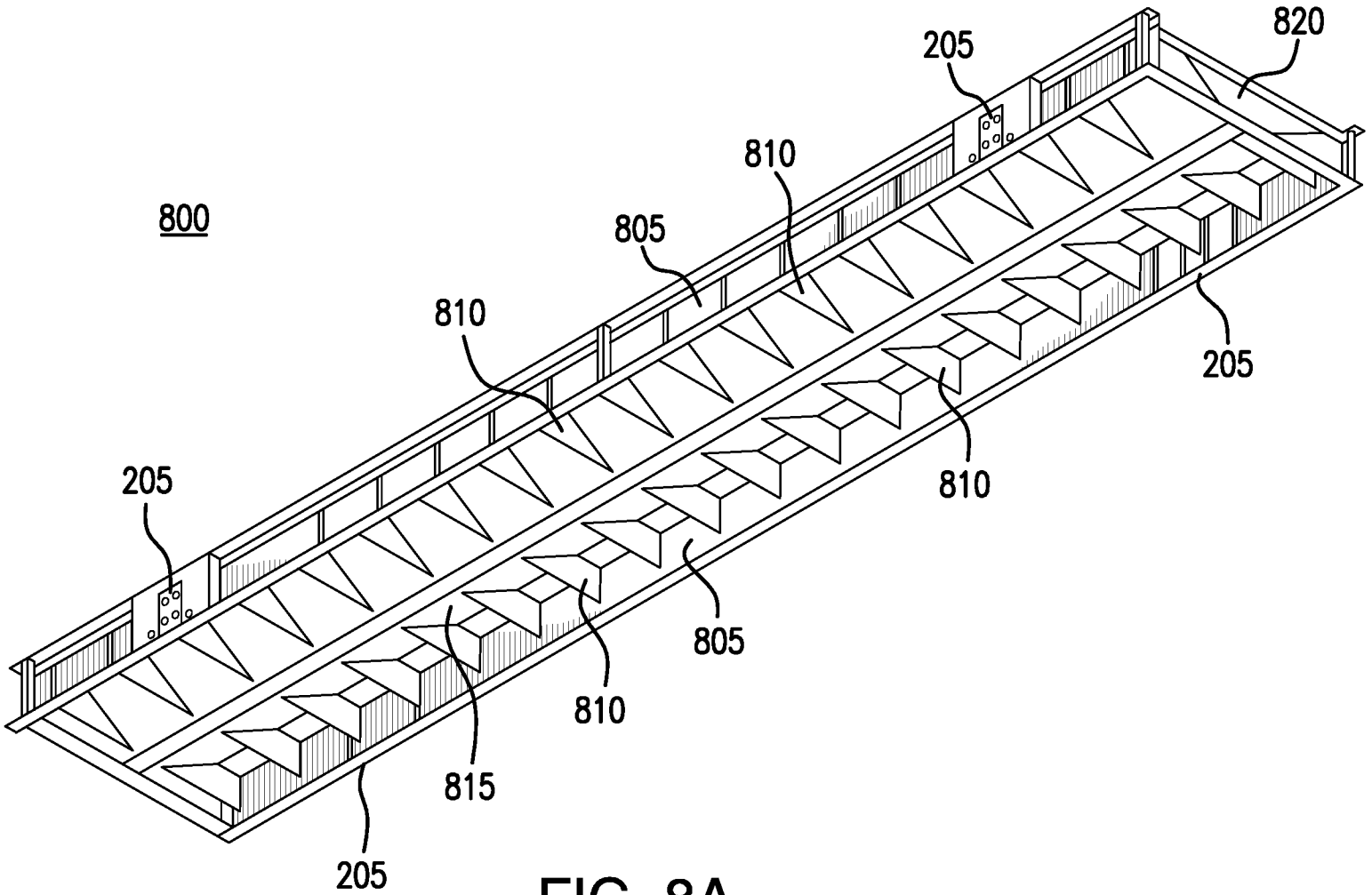
FIGS. 8A and 8B illustrate isometric views of the underside and top, respectively, of an example modular longitudinal coil car top.
Figure 8B:
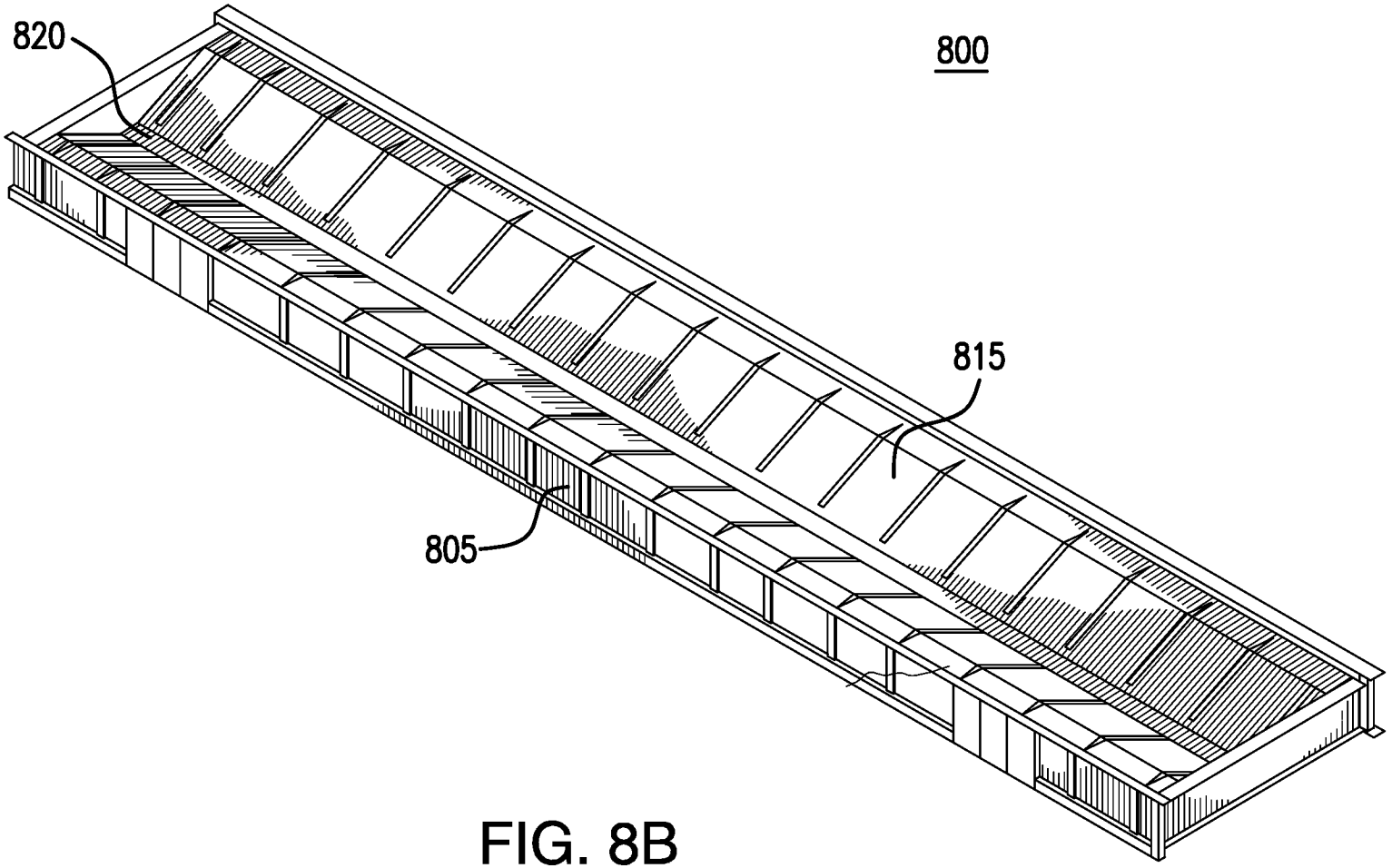

In addition to modular coil car tops that can be used to transport coils positioned in the transverse direction, the modular coil car tops of the present disclosure may also be used to transport coils positioned parallel to the longitudinal axis of railcar 100. FIGS. 8A and 8B present an example modular longitudinal coil car top 800 configured to transport coils positioned parallel to the longitudinal axis of the modular railcar.

FIG. 8A illustrates the underside of the example modular longitudinal coil car top 800, while FIG. 8B illustrates the top of modular longitudinal coil car top 800. As illustrated in FIGS. 8A and 8B, modular longitudinal coil car top 800 includes a pair of sidewalls 805 and a trough 820 positioned between the sidewalls. Trough 820 is formed from floor sheet 815, which is supported by a plurality of gussets 810. Floor sheet 815 includes a pair of sloped portions and a horizontal portion, located between each sloped portion. Each sloped portion of the pair of sloped portions slopes downwards from a sidewall 805 towards the horizontal portion. The horizontal portion defines the bottom of trough 820. Floor sheet 815 may be formed from any number of sheets of metal. For example, in certain embodiments, floor sheet 815 may be formed from a single sheet of metal. As another example, in certain embodiments, floor sheet 815 may be formed from a pair of sheets of metal, with each sheet of metal of the pair of sheets of metal forming a sloped portion of floor sheet 815. In some such embodiments, the pair of sheets of metal may be configured to overlap one another at the horizontal bottom of trough 820. As another example, in certain embodiments, floor sheet 815 may be formed from any number of sheets of metal, with each sheet of metal spanning a portion of the longitudinal extent of trough 820.

As illustrated in FIG. 8A, each gusset 810 may be formed as a metal plate of any suitable thickness. Gussets 810 may be positioned substantially parallel to one another and extend in a direction perpendicular to the longitudinal axis of modular longitudinal coil car top 800. Each gusset 810 is coupled at a first side to a sidewall 805 and may support a portion of one of the sloped portions of floor sheet 815. Accordingly, a second side of each gusset 810 is configured to slope downwards, away from sidewall 205, with one of the sloped portions of floor sheet 815 resting on top of this second side. Gussets 810 may transfer the vertical load of coils 125, transported within trough 820, into sidewalls 805. While illustrated as including nineteen gussets 810 on each side of trough 820, this disclosure contemplates that modular longitudinal coil car top 800 may include any number of gussets 810.

Similar to the modular transverse coil car tops described above, modular longitudinal coil car top 800 may couple to a common underframe using coupling apparatuses 205, as described in further detail below, in the discussion of FIGS. 9 through 11. Modular longitudinal coil car top 800 may include any number of coupling apparatuses 205. For example, as illustrated in FIG. 8A, modular longitudinal coil car top 800 may include two pairs of coupling apparatuses 205-*a* first pair of coupling apparatuses 205 located near a first end of modular longitudinal coil car top 800 and a second pair of coupling apparatuses 205 located near a second end of modular coil car top 800.

While illustrated in FIGS. 8A and 8B as including one longitudinal trough 820, this disclosure contemplates that modular longitudinal coil car top 800 may include any number of longitudinal troughs 820. Additionally, in certain embodiments, modular coil car top 800 may include a combination of longitudinal and transverse troughs.

Figure 9A:
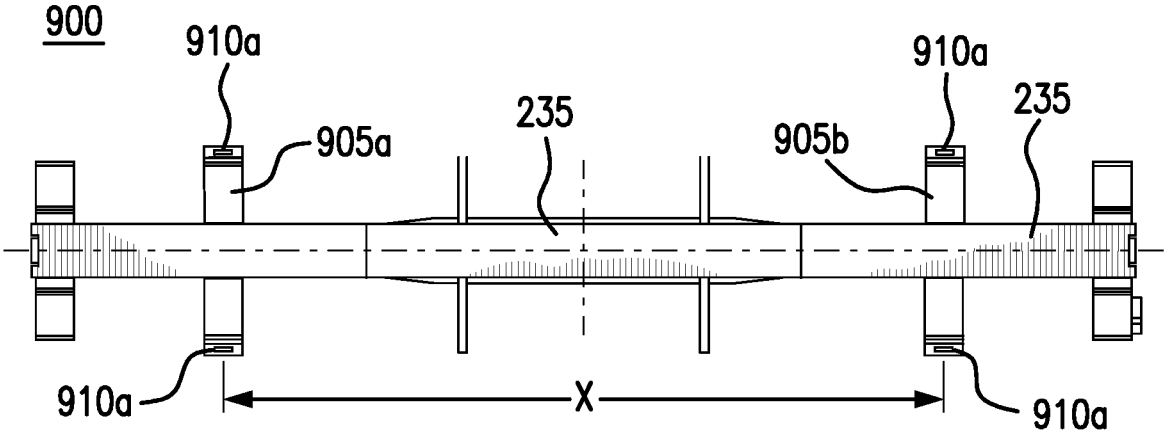
FIGS. 9A and 9B illustrate top-down views of example railcar underframes configured to couple to the modular coil car top of the present disclosure at a set of attachment points located on the underframe.
Figure 9B:
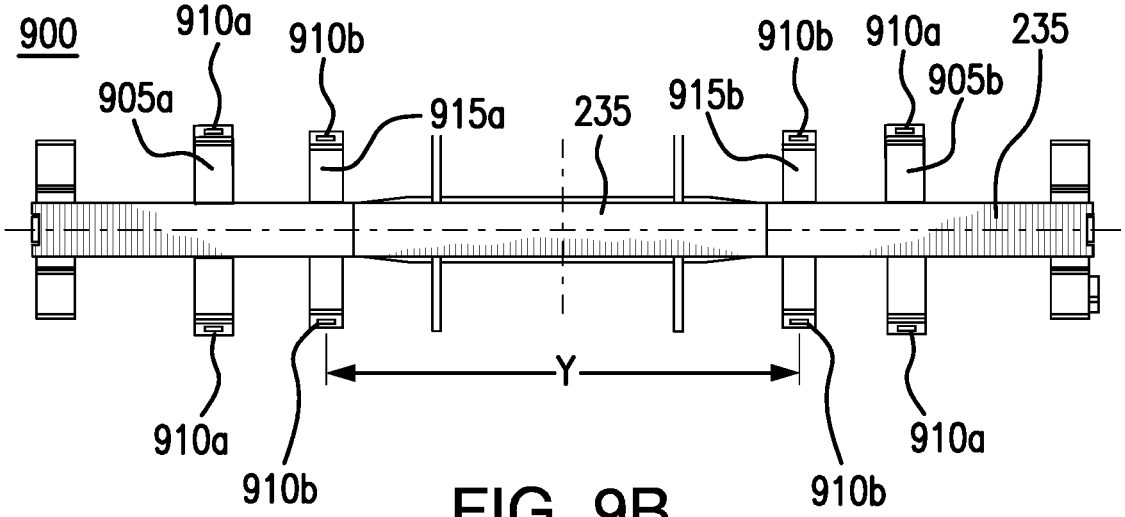

As described above, modular coil car tops 200, 500, 600, 700, and 800 may couple to a common underframe. FIGS. 9A and 9B present example embodiments of common underframe 900. As illustrated in FIGS. 9A and 9B, common underframe 900 includes center sill 235. As described above, in certain embodiments, center sill 235 is configured to receive vertical loads from coils 125 transported in the modular coil car tops.

As illustrated in FIG. 9A, in certain embodiments, common underframe 900 includes coupling apparatuses 910*a* located on bolsters 905. For example, common underframe 900 includes coupling apparatuses 910*a* located near each end of each bolster 905. As illustrated in FIG. 9A, the coupling apparatuses 910*a* on first bolster 905*a* are separated from the coupling apparatuses 910*a* on second bolster 905*b* by a longitudinal distance X. Each coupling apparatus 910*a* on underframe 900 may be configured to couple with a corresponding coupling apparatus 205 of the modular coil car top of the present disclosure, as described in further detail below, in the discussion of FIGS. 10 and 11.

In certain embodiments, in addition to or instead of locating coupling apparatuses 910*a* on bolsters 905, in certain embodiments, coupling apparatuses may be located on cross-bearers 915 of common underframe 900. FIG. 9B illustrates a common underframe 900 that includes coupling apparatuses 910*a* on bolsters 905 as well as coupling apparatuses 910*b* on cross-bearers 915. For example, common underframe 900 includes coupling apparatuses 910*b* located near each end of each cross-bearer 915. As illustrated in FIG. 9B, the coupling apparatuses 910*b* on first cross-bearer 915*a* are separated from the coupling apparatuses 910*b* on second cross-bearer 915*b* by a longitudinal distance Y, where distance Y is shorter than distance X. Including coupling apparatuses 910 at multiple locations on common underframe 900 may enable common underframe 900 to couple to a variety of different modular tops. For example, a first modular top may be configured to couple to modular underframe 900 using coupling apparatuses 910*a*, while a second modular top (e.g. a modular top that is shorter than the first modular top) may be configured to couple to modular underframe 900 using coupling apparatuses 910*b*. Coupling apparatuses 910*b* may go unused when common underframe 900 is coupled to a modular top using coupling apparatuses 910*a*. Similarly, coupling apparatuses 910*a* may go unused when common underframe 900 is coupled to a modular top using coupling apparatuses 910*b*. This disclosure contemplates that common underframe 900 may include any number of coupling apparatuses 910. For example, additional coupling apparatuses 910 may be added to underframe 900 by adding additional cross-bearers 815 to underframe 900, with a coupling apparatus 910 installed near either end of each additional cross-bearer 915. In certain embodiments, the positions of coupling apparatuses 910 may vary transversely across common underframe 900 to accommodate modular tops of various widths.

This disclosure contemplates that a modular top may be coupled to common underframe 900 in any suitable manner. As an example, in certain embodiments, the modular top may include one or more apparatuses that are each designed to couple to a corresponding apparatus on the common underframe. For example, in certain embodiments, the modular top may include one or more apparatuses in the form of female portions (e.g., recessed portions), each of which is configured to couple to a corresponding apparatus on common underframe 900 in the form of a male portion (e.g., protruding portion), coupled to the underframe. In some embodiments, the modular top may include one or more apparatuses in the form of male portions (e.g., protruding portions), each of which is configured to couple to a corresponding apparatus on common underframe 900 in the form of a female portion (e.g., recessed portion), coupled to the underframe. In such embodiments, the modular top may be configured to be lifted off of/lowered onto common underframe 900. When the modular top is lowered onto common underframe 900, the male portions of the coupling apparatus slide into the female portions of the coupling apparatus. FIGS. 10A through 10D present an example coupling apparatus that includes a female coupler portion and FIGS. 11A through 11C present an example coupling apparatus that includes a male coupler portion, for use in such embodiments.

Figure 10A:
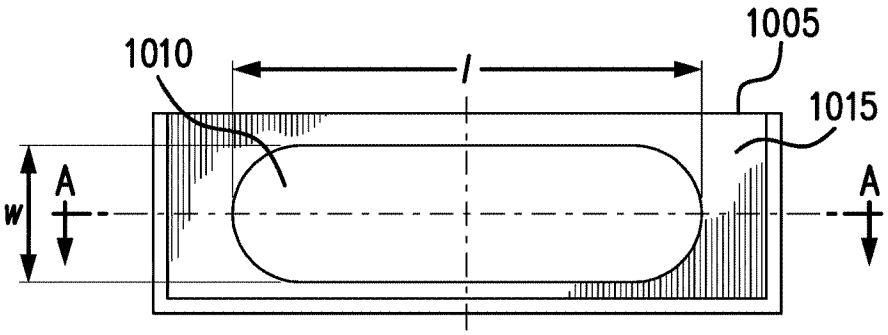
FIGS. 10A through 10D present an example coupling apparatus configured to couple the modular coil car top of the present disclosure to the railcar underframes of FIG. 9A and/or FIG. 9B.
Figure 11A:
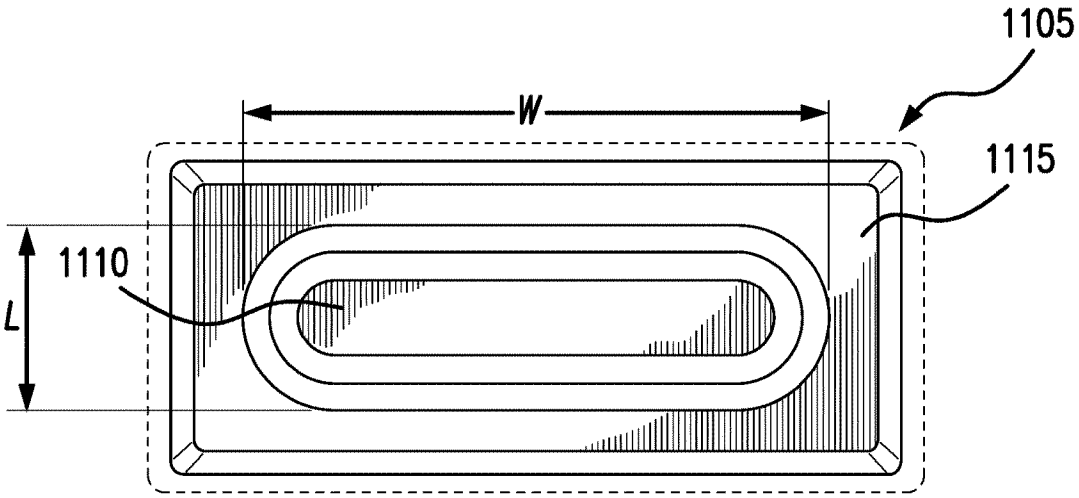
FIGS. 11A through 11C present an additional example of a coupling apparatus configured to couple the modular coil car top of the present disclosure to the underframes of FIGS. 9A and/or 9B.
Figure 11B:
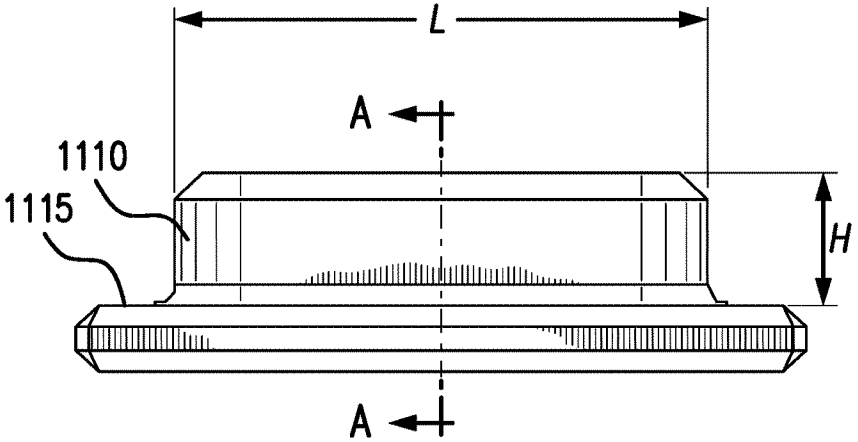
Figure 11C:
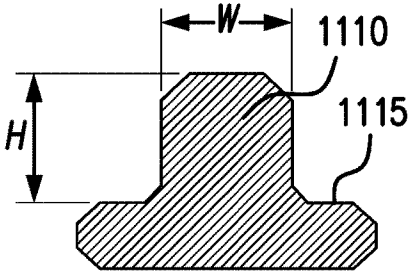

FIG. 10A is an overhead schematic of a female portion 1005 of a coupling apparatus, according to some embodiments. Female coupler portion 1005 includes recessed portion 1010 for receiving a corresponding male coupler portion. Recessed portion 1010 is positioned on a surface 1015. In certain embodiments in which the coupling apparatus that includes female portion 1005 is coupled to common underframe 900, surface 1015 includes a surface on common underframe 900 and/or is coupled to common underframe 900. As an example, surface 1015 may include a surface on a bolster 910 and/or a cross-bearer 915 and/or surface 1015 may be coupled to a bolster 910 and/or a cross-bearer 915. For example, in certain embodiments, female portion 1005 may be installed, mechanically or otherwise, onto a surface of a bolster 910 and/or a cross-bearer 915. For instance, in certain embodiments, female portion 1005 may be welded to a surface of a bolster 910 and/or a cross-bearer 915. In some embodiments, a bolster 910 and/or a cross-bearer 915 may be formed to integrally include female portion 1005. In some embodiments in which the coupling apparatus that includes female portion 1005 is coupled to modular top 200, surface 1015 includes a surface on the underside of modular top 200 and/or is coupled to a surface on the underside of modular top 200. For example, in certain embodiments, female portion 1005 may be installed, mechanically or otherwise, onto a surface of the underside of modular top 200. For instance, in certain embodiments, female portion 1005 may be welded to a surface of the underside of modular top 200. In some embodiments, female portion 1005 may be integrally formed together with modular top 200.

Female coupler portion 1005 may be formed from a metal, such as steel, or any other suitable material. For example, in certain embodiments, female coupler portion 1005 may be formed from the same material as a surface of underframe 900. In some embodiments, female coupler portion 1005 may be formed from the same material as a surface of the underside of modular top 200. In certain embodiments, female coupler portion 1005 may be formed from a different material from the material forming the surface of underframe 900 and/or the surface forming the underside of modular top 200.

Figure 10B:
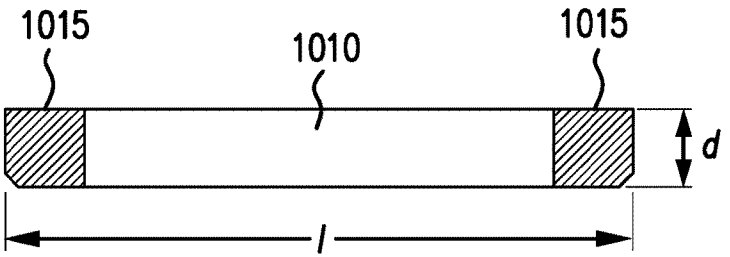
Figure 10C:
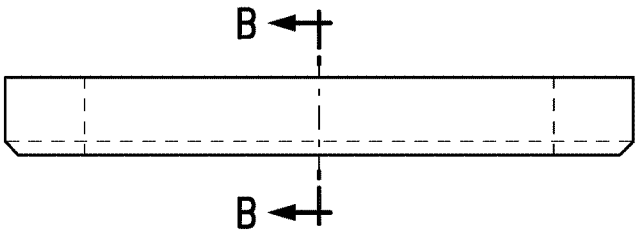
Figure 10D:
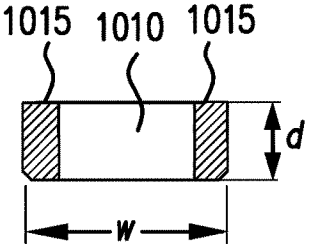

FIG. 10B is a cross-section schematic of the female portion 1005 of the coupling apparatus illustrated in FIGS. 10A through 10D. The illustrated cross-section is viewed from the line labeled A-A in FIG. 10A. FIG. 10C is a side view schematic of the female portion 1005 of the coupling apparatus illustrated in FIGS. 10A through 10D. FIG. 10D is another cross-section schematic of the female portion 1005 of the coupling apparatus illustrated in FIGS. 10A through 10D. The illustrated cross-section of FIG. 10D is viewed from the line labeled B-B in FIG. 10C.

As illustrated in FIGS. 10A through 10D, recessed portion 1010 of female portion 1005 is of a length l at its longest dimension, a width w at its widest dimension, and a depth d at its deepest dimension. This disclosure contemplates that recessed portion 1010 of female coupling portion 1005 may include any recessed geometry. For example, in certain embodiments, recessed portion 1010 may include a rectangular recessed portion of length l, width w, and uniform depth d. As another example, in certain embodiments (and as illustrated in FIGS. 10A through 10D), recessed portion 1010 may include a stadium-shaped recessed portion of uniform depth d, wherein the stadium-shape includes a rectangle of length $l-2r$, and width $w=2r$, in which the sides of the rectangle along the direction of its length are capped with semicircles of radius r. In certain other embodiments, recessed portion 1010 may include a rectangular geometry or a stadium-shaped geometry, with non-uniform depth d. For example, in certain such embodiments, recessed portion 1010 may include a taper in the direction away from surface 1015, such that a length of recessed portion 1010, measured at depth d (e.g., the bottom of recessed portion 1010), and a width of recessed portion 1010, measured at depth d, are smaller that length l and width w, measured at surface 1015.

FIG. 11A is an overhead schematic of a male portion of a coupling apparatus, according to some embodiments. Male coupler portion 1105 includes protruding portion 1110 for fitting into a corresponding recessed portion 1010 of female coupler portion 1005. Protruding portion 1110 is positioned on a surface 1115. In certain embodiments in which the coupling apparatus that includes male portion 1105 is coupled to common underframe 900, surface 1115 includes a surface on common underframe 900 and/or is coupled to common underframe 900. As an example, surface 1115 may include a surface on a bolster 910 and/or a cross-bearer 915 and/or surface 1115 may be coupled to a bolster 910 and/or a cross-bearer 915. For example, in certain embodiments, male portion 1105 may be installed, mechanically or otherwise, onto a surface of a bolster 910 and/or a cross-bearer 915. For instance, in certain embodiments, male portion 1105 may be welded to a surface of a bolster 910 and/or a cross-bearer 915. In some embodiments, a bolster 910 and/or a cross-bearer 915 may be formed to integrally include male portion 1105. In some embodiments in which the coupling apparatus that includes male portion 1105 is coupled to modular top 200, surface 1115 includes a surface on the underside of modular top 200 and/or is coupled to the underside of modular top 200. For example, in certain embodiments, male portion 1105 may be installed, mechanically or otherwise, onto a surface of the underside of modular top 200. For instance, in certain embodiments, male portion 1105 may be welded to a surface of the underside of modular top 200. In some embodiments, male portion 1105 may be integrally formed together with modular top 200.

Male coupler portion 1105 may be formed from a metal, such as steel, or any other suitable material. For example, in certain embodiments, male coupler portion 1105 may be formed from the same material as a surface of common underframe 900. In some embodiments, male coupler portion 1105 may be formed from the same material as a surface of the underside of modular top 200. In certain embodiments, male coupler portion 1105 may be formed from a different material from the material that forms the surface of common underframe 900 and/or the surface forming the underside of modular top 200.

The protruding portion 1110 of male coupler portion 1105 is sized to fit within the recessed portion 1010 of female coupler portion 1005. In particular embodiments, protruding portion 1110 may be sized somewhat smaller than recessed portion 1010. For example, in certain embodiments, protruding portion 1110 may be between 1/16 to 1 inch smaller than recessed portion 1010. The use of a smaller protruding portion 1110, as compared to the corresponding recessed portion 1010, may help to facilitate slippage (longitudinally and/or transversely) between modular top 200 and underframe 900. This slippage may prevent or reduce action loads from transferring to modular top 200 from underframe 900 and/or lading loads from transferring from modular top 200 to underframe 900. In certain embodiments, the use of a smaller protruding portion 1110, as compared to the corresponding recessed portion 1010, may also help to enable easy installation of modular top 200 onto underframe 900.

FIG. 11B is a side view schematic of the male coupler portion 1105 of the coupling apparatus illustrated in FIGS. 11A through 11C. FIG. 11C is a cross-section schematic of the male coupler portion 1105 of the coupling apparatus illustrated in FIGS. 11A through 11C. The illustrated cross-section of FIG. 11C is viewed from the line labeled A-A in FIG. 11B.

As illustrated in FIGS. 11A through 11C, protruding portion 1110 is of a length L at its longest dimension, a width W at its widest dimension, and a height H at its tallest dimension. This disclosure contemplates that protruding portion 1110 of male coupler portion 1105 may include any protruding geometry capable of fitting into recessed portion 1010 of female portion 1005. For example, in certain embodiments, protruding portion 1110 may include a rectangular-shaped protruding portion of length L, width W, and uniform height H, where L is somewhat less than l, W is less than w, and H is less than d, where l, w, and d define dimensions of recessed portion 1010, as described above, in the discussion of FIGS. 10A through 10D. As another example, in certain embodiments, protruding portion 1110 may include a stadium-shaped protruding portion of uniform height H, wherein the stadium-shape includes a rectangle of length L−2R, and width W=2R, in which the sides of the rectangle along the direction of its length are capped with semicircles of radius R, and R is less than r, where r defines a dimension of recessed portion 1010, as described above, in the discussion of FIGS. 10A through 10D. In certain embodiments, protruding portion 1110 may include a rectangular geometry or a stadium-shaped geometry, with non-uniform height H. For example, in certain such embodiments, protruding portion 1110 may include a taper in the direction away from surface 1115, such that a length of protruding portion 1110, measured at height H (e.g., the top of protruding portion 1110), and a width of protruding portion 1110, measured at height H, are smaller than length L and width W, measured at surface 1115.

Under normal operating conditions, the weight of modular top 200 may be enough to keep the male portion 1105 of a coupling apparatus that is installed on modular top 200 coupled to the female portion 1005 of a corresponding coupling apparatus installed on underframe 900 and/or to keep the female portion 1005 of a coupling apparatus that is installed on modular top 200 coupled to the male portion 1105 of a corresponding coupling apparatus that is installed on underframe 900. Particular embodiments may include one or more fasteners configured to keep male portion 1105 coupled to female portion 1005. Each fastener may include a nut and bolt, or any other suitable fastener. One or more fasteners prevent or resist separation of modular top 200 from common underframe 900 under particular conditions including, for example, an emergency condition such as a derailment.

Figure 12A:
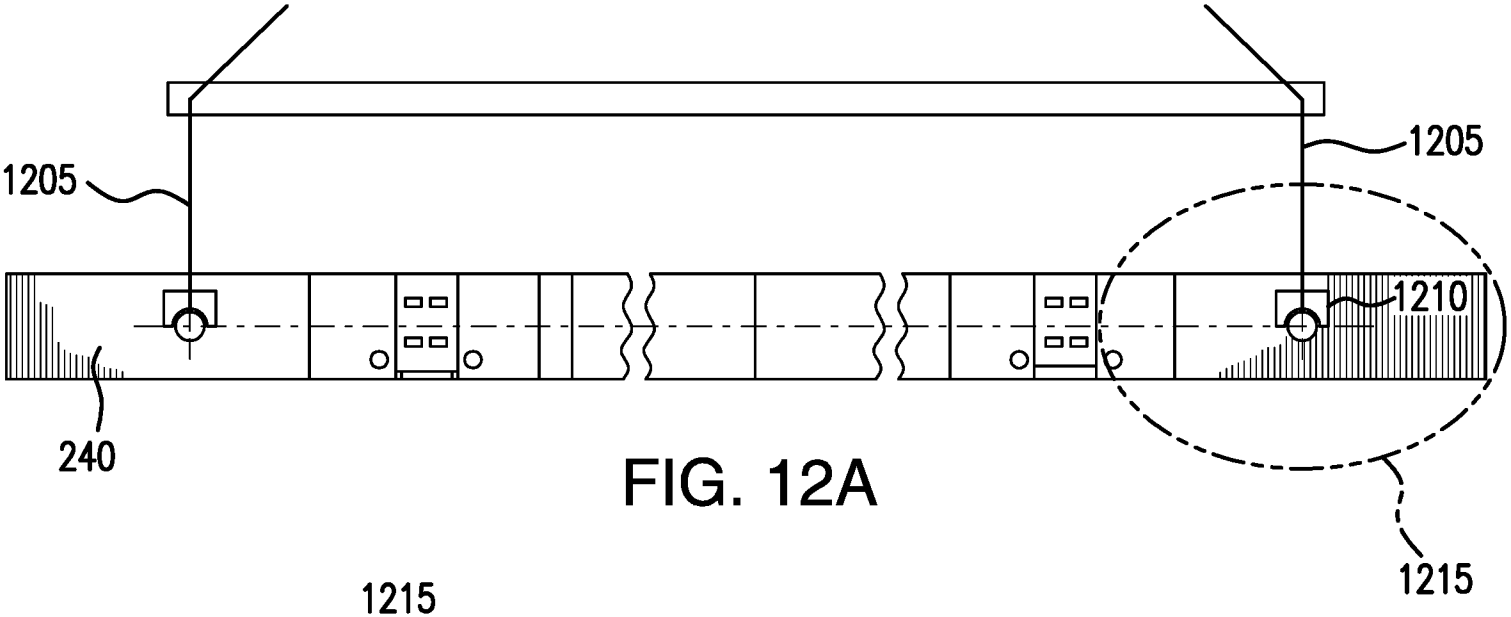
FIGS. 12A and 12B illustrate the use of a hoist to lift the modular coil car top of the present disclosure onto and/or off of a railcar underframe.
Figure 12B:
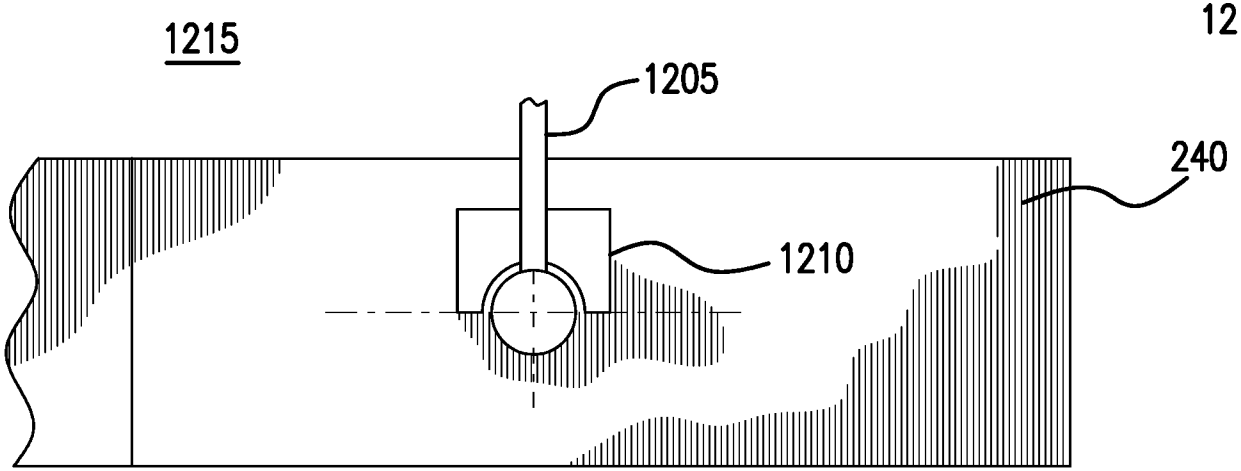

In operation, a railyard operator may use a crane, hoist, or any other suitable equipment or machinery to couple or decouple modular top 200 to/from common underframe 900. FIGS. 12A and 12B illustrate the use of a hoist 1205 to lift modular coil car top 200. As illustrated in FIGS. 12A and 12B, hoist 1205 may be coupled to modular top 200 at attachments 1210. Attachments 1210 are coupled to side sills 240. For example, a first attachment 1210 may be coupled to side sill 240 near a first end of side sill 240 and a second attachment 1210 may be couple to side sill 240 near a second end of side sill 240. In certain embodiments, modular tops 200 may be loaded with coils 125 prior to being lifting onto common underframe 900. Similarly, loaded modular tops 200 may be decoupled from common underframe 900 and lifted off of common underframe 900 prior to being unloaded. In this manner, when a modular coil railcar arrives at a loading station a hoist 1205 may be used to lift a first loaded modular top 200 off of common underframe 900, and a hoist 1205 may be used to lift a second loaded modular top 200 onto common underframe 900. In certain embodiments, this may increase the efficiency of the loading/unloading process, by reducing the time used to load the coil railcar.

Figure 13:
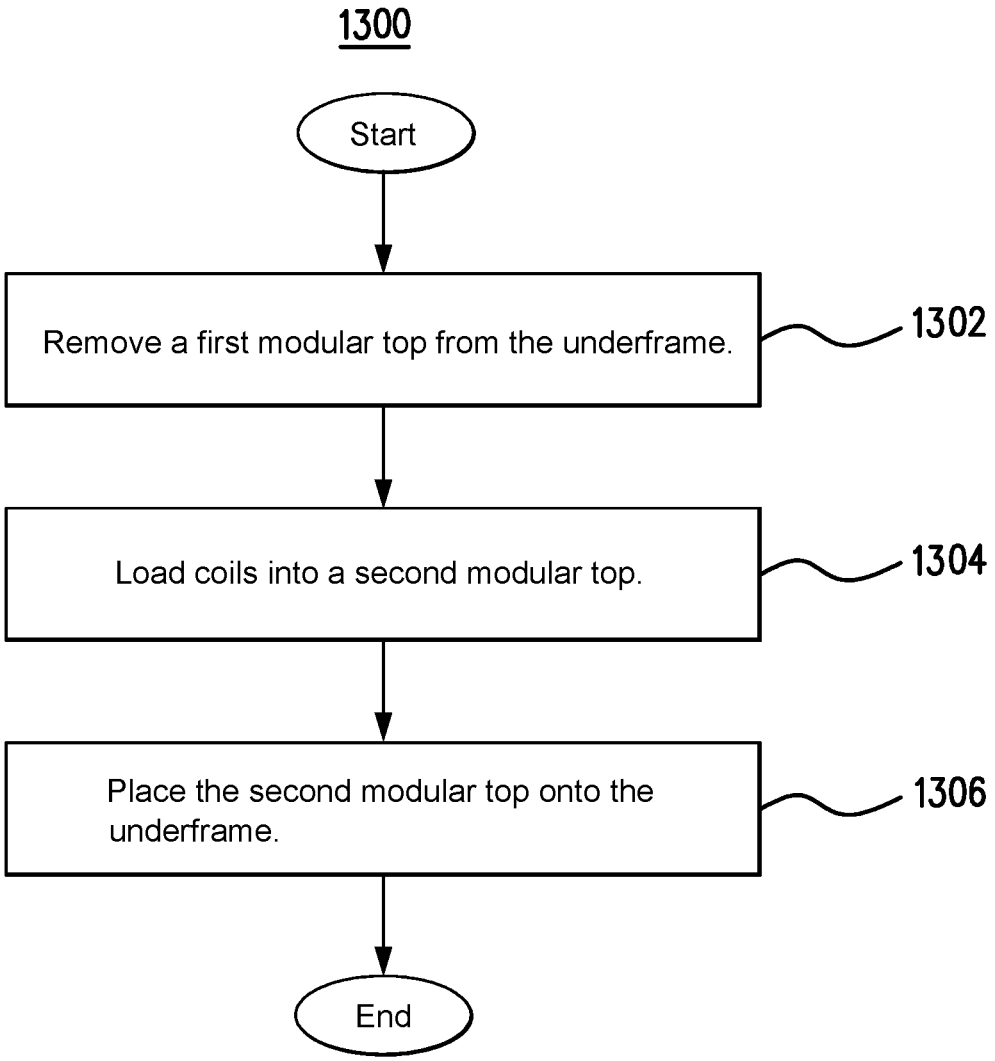
FIG. 13 presents a flowchart illustrating an example method of operating the modular coil car top of the present disclosure.

FIG. 13 presents an example method 1300 (described in conjunction with FIGS. 2A through 2D, 8A, 8B, 9A, 9B, 10A through 10D, and 11A through 11C) for operating the modular coil railcar of the present disclosure. In step 1302 a first modular coil car top 200/800 is removed from a common underframe 900. In certain embodiments, first modular coil car top 200/800 is holding a first set of coils. Removing the first modular coil car top from the common underframe includes disengaging one or more coupling apparatuses (e.g., male coupler portion 1105 and/or female coupler portion 1005) of first modular coil car top 200/800 from one or more coupling apparatuses (e.g., female coupler portion 1005 and/or male coupler portion 1105). In certain embodiments, a crane and/or hoist may be used to remove first modular coil car top 200/800 from common underframe 900. In certain embodiments in which first modular top is transporting the first set of coils, the coils may be removed from first modular top 200/800 prior to removing the top from underframe 900. In some embodiments, the coils are removed from first modular top 200 after the top is removed from underframe 900.

In step 1304 one or more coils of material are loaded into a second modular coil car top 200/800. For example, a forklift or other equipment may be used to load coils into second modular coil car top 200/800. In step 1306 second modular coil car top 200/800 is placed on top of common underframe 900. Placing second modular coil car top 200/800 on top of common underframe 900 may include engaging one or more coupling apparatuses (e.g., male coupler portion 1105 and/or female coupler portion 1005) of second modular coil car top 200/800 with one or more coupling apparatuses (e.g., female coupler portion 1005 and/or male coupler portion 1105). In certain embodiments, a crane and/or hoist may be used to lift second modular coil car top 200/800 onto common underframe 900. In some embodiments, steps 1304 and 1306 are performed in the opposite order. For example, coils may be loaded into second modular coil car top 200/800 after the top has been placed on top of common underframe 900.

Second modular coil car top 200/800 may be the same or a different type of top as first modular coil car top 200/800. For example, first modular coil car top may be a transverse coil car top 200 that is configured to hold N coils, or a longitudinal coil car top 800 that is configured to hold M coils. Similarly, second modular coil car top may be a transverse coil car top 200 that is configured to hold P coils, or a longitudinal coil car top 800 that is configured to hold R coils, where P is the same or a different number than N, and R is the same or a different number than M.

Modifications, additions, or omissions may be made to method 1300 depicted in FIG. 13. Method 1300 may include more, fewer, or other steps. For example, steps may be performed in parallel or in any suitable order. One or more steps may be performed by an individual, a machine, any other device, or a combination of the preceding.

Figure 14:
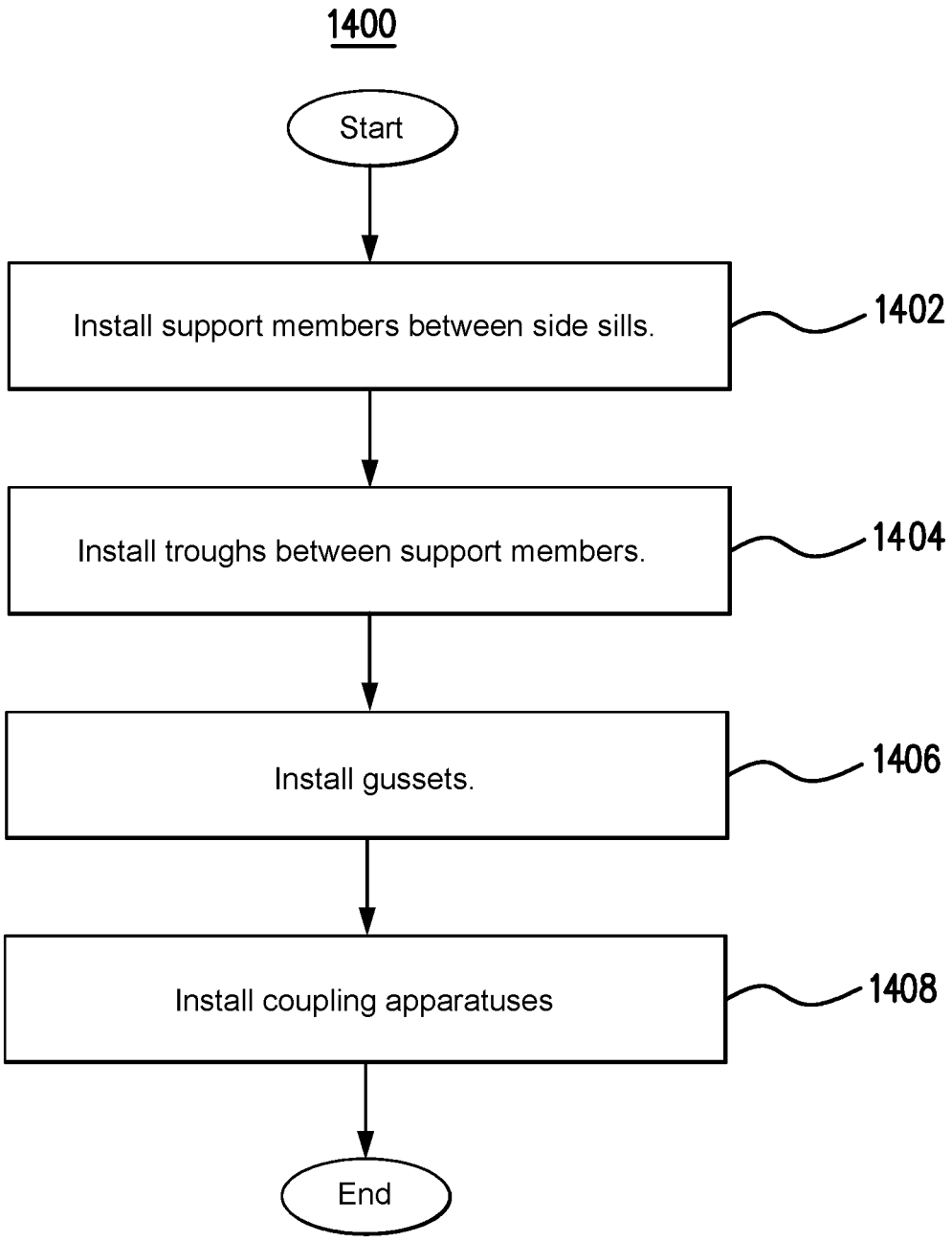
FIG. 14 presents a flowchart illustrating an example method of manufacturing the modular coil car top of the present disclosure.

FIG. 14 presents an example method 1400 (described in conjunction with FIGS. 2A through 2D, 9A, 9B, 10A through 10D, and 11A through 11C) for manufacturing modular coil car top 200. In step 1402 a set of support members 220 are installed between a pair of side sills 240. When modular coil car top 200 is placed onto common underframe 900, support members 220 are configured to transfer vertical coil loads into center sill 235 of common underframe 900. In step 1404 a trough 210 is installed between each pair of adjacent support members 220. Each trough 210 may be formed from one or more angled sheets of metal 225. For example, in certain embodiments, a trough 210 is formed from a single sheet of metal 225 that is coupled to a first support member 220 at a first end and to a second support member 220 that is adjacent to the first support member at a second end, and includes: (1) a first sloped portion that slopes down and away from the first support member; (2) a horizontal portion which defines the lowest position of the trough; and (3) a second sloped portion that slopes up and towards the second support member. In some embodiments, a trough 210 is formed from two sheets of metal that overlap one another at the bottom of the trough. Each sheet of metal 225 may be coupled to one or more support members 220 in any suitable manner. For example, in certain embodiments, the sheet of metal is welded to the top of support member 220.

In step 1406 support gussets 230 are installed on modular coil car top 200. Each gusset 230 is coupled to a support member 220, and extends from support member 220 in a generally perpendicular direction. Gussets 230 may be coupled to support members 220 in any suitable manner. For example, in certain embodiments, gussets 230 are welded to support members 220. Installing gussets 230 in modular coil car top 200 after installed metal floor sheets 225 may be desirable to taking into account various manufacturing tolerances. For example, installing gussets 230 after metal floor sheets 225 may help to ensure that the gussets 230 are able to fully support floor sheets 225 while at the same time being securely attached to support members 220.

In step 1408 one or more coupling apparatuses are installed on the underside of modular top 200. Each coupling apparatus is configured to engage a corresponding coupling apparatus of common underframe 900. For example, each coupling apparatus may include a female portion 1005 and/or a male portion 1105 that is configured to engage a corresponding male portion 1105 and/or a female portion 1005 of a coupling apparatus of underframe 900. In certain embodiments, installing the one or more coupling apparatuses includes welding the coupling apparatuses to the underside of modular coil car top 200.

Modifications, additions, or omissions may be made to method 1400 depicted in FIG. 14. Method 1400 may include more, fewer, or other steps. For example, steps may be performed in parallel or in any suitable order. One or more steps may be performed by an individual, a machine, any other device, or a combination of the preceding.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as falling within the scope of the appended claims.

What is claimed is:

1. A modular railcar comprising:

a modular top system configured to hold one or more coils of material, the modular top system comprising:

a pair of side sills, each side sill of the pair of side sills extending a longitudinal length of the modular top system; and one or more troughs disposed between the pair of side sills, each trough of the one or more troughs configured to hold a coil of the one or more coils of material; and a railcar underframe configured to support the modular top system, the underframe comprising one or more coupling apparatuses configured to detachably engage the modular top system when the modular top system is positioned on top of the underframe;

wherein a side sill of the pair of side sills comprises a scalloped upper edge defining one or more indentations;

each support member of the plurality of support members extends in a transverse direction between the pair of side sills; and each indentation of the one or more indentations is associated with a trough of the one or more troughs, wherein a position of a center of the indentation along the length of the modular top system generally corresponds to a position of a center of the associated trough along the length of the modular top system.

2. The modular railcar of claim 1, wherein:

each trough of the one or more troughs comprises one or more angled floor sheets, each floor sheet of the one or more angled floor sheets comprising:

a pair of sloped sides; and a horizontal bottom; and the modular top system further comprises a plurality of gussets, each gusset of the plurality of gussets coupled to at least one trough of the one or more troughs and configured to support a sloped side of the pair of sloped sides of the at least one trough.

3. The modular railcar of claim 2, further comprising a plurality of support members, wherein:

each trough of the one or more troughs is positioned between a pair of adjacent support members of the plurality of support members; and each gusset of the plurality of gussets extends between a support member of the plurality of support members and a sloped side of the pair of sloped sides of a trough of the one or more troughs.

4. The modular railcar of claim 3, wherein each of the one or more angled floor sheets comprises a single sheet of metal, the single sheet of metal comprising:

a first end coupled to a top of a first support member of the plurality of support members; and a second end opposite the first end and coupled to a top of a second support member of the plurality of support members, the second support member adjacent to the first support member.

5. The modular railcar of claim 3, wherein each angled floor sheet of the one or more angled floor sheets comprises:

a first sheet of metal comprising a first end and a second end, the first end coupled to a top of a first support member of the plurality of support members; and a second sheet of metal comprising a first end and a second end, the second end of the second sheet coupled to a top of a second support member of the plurality of support members, the second support member adjacent to the first support member, wherein:

the horizontal bottom of the angled floor sheet comprises the second end of the first sheet of metal and the first end of the second sheet of metal; and a portion of the first sheet of metal comprising the second end of the first sheet overlaps a portion of the second sheet of metal comprising the second end of the second sheet.

6. The modular railcar of claim 1, wherein:

the railcar underframe further comprises:

a center sill; and one or more cross members, each cross member of the one or more cross members coupled to the center sill and extending in a direction transverse to the center sill; and each of the one or more coupling apparatuses is coupled to a cross member of the one or more cross members.

7. The modular railcar of claim 1, wherein the modular top system further comprises one or more coupling apparatuses positioned on an underside of the modular top system, each of the one or more coupling apparatuses of the modular top system associated with a coupling apparatus of the one or more coupling apparatuses of the railcar underframe, and comprising at least one of:

a protruding portion, wherein the associated coupling apparatus of the railcar underframe comprises a recessed portion configured to detachably engage the protruding portion of the coupling apparatus of the modular top system; and a recessed portion, wherein the associated coupling apparatus of the railcar underframe comprises a protruding portion configured to detachably engage the recessed portion of the coupling apparatus of the modular top system.

8. A method comprising:

removing a first modular top system from a railcar underframe, wherein:

the first modular top system is configured to hold one or more coils of material, and comprises:

a pair of side sills, each side sill of the pair of side sills extending a longitudinal length of the modular top system; and one or more troughs disposed between the pair of side sills, each trough of the one or more troughs configured to hold a coil of the one or more coils of material;

the railcar underframe comprises one or more coupling apparatuses configured to detachably engage the first modular top system; and removing the first modular top system from the railcar underframe comprises disengaging the first modular top system from the one or more coupling apparatuses of the railcar underframe; and placing a second modular top system on the railcar underframe, wherein:

the one or more coupling apparatuses of the railcar underframe is further configured to detachably engage the second modular top system; and placing the second modular top system on the railcar underframe comprises engaging the second modular top system with the one or more coupling apparatuses of the railcar underframe.

9. The method of claim 8, wherein removing the first modular top system from the railcar underframe comprises lifting the first modular top system off of the railcar underframe using at least one of a crane and a hoist.

10. The method of claim 8, further comprising, in response to removing the first modular top system from the railcar underframe, unloading each coil of the one or more coils of material from the first modular top system.

11. The method of claim 10, wherein:

a side sill of the pair of side sills of the first modular top system comprises a scalloped upper edge defining one or more indentations, each indentation of the one or more indentations extending from a maximum height of the side sill to a minimum height of the side sill;

each indentation of the one or more indentations is associated with a trough of the one or more troughs, wherein a position of a center of the indentation along the length of the first modular top system generally corresponds to a position of a center of the associated trough along the length of the first modular top system; and unloading a coil of the one or more coils of material from the first modular top system comprises accessing a central longitudinal axis of the coil through the indentation associated with the trough of the one or more troughs in which the coil is held, wherein a height of the central longitudinal axis of the coil is greater than the minimum height of the side sill and less than the maximum height of the side sill.

12. The method of claim 8, wherein:

the railcar underframe further comprises a center sill;

each trough of the one or more troughs of the first modular top extends in a direction generally parallel to the center sill, while the first modular top system is engaged to the one or more coupling apparatuses of the railcar underframe; and the second modular top system comprises one or more troughs, each trough of the one or more troughs of the second modular top system extending in a direction generally transverse to the center sill, while the second modular top system is engaged to the one or more coupling apparatuses of the railcar underframe.

13. The method of claim 8, wherein:

each trough of the one or more troughs of the first modular top system comprises one or more angled floor sheets, each floor sheet of the one or more angled floor sheets comprising:

a pair of sloped sides; and a horizontal bottom; and the first modular top system further comprises a plurality of gussets, each gusset of the plurality of gussets coupled to at least one trough of the one or more troughs and configured to support a sloped side of the pair of sloped sides of the at least one trough.

14. The method of claim 13, wherein the first modular top system further comprises a plurality of support members, wherein:

each trough of the one or more troughs is positioned between a pair of adjacent support members of the plurality of support members; and each gusset of the plurality of gussets extends between a support member of the plurality of support members and a sloped side of the pair of sloped sides of a trough of the one or more troughs.

15. A modular top system configured to hold one or more coils of material, the modular top system comprising:

a pair of side sills;

one or more troughs disposed between the pair of side sills, each trough of the one or more troughs configured to hold a coil of the one or more coils of material; and one or more coupling apparatuses configured to detachably couple to a railcar underframe, wherein each coupling apparatus of the one or more coupling apparatuses comprises at least one of:

a protruding portion configured to detachably engage a recessed portion of the railcar underframe; and a recessed portion configured to detachably engage a protruding portion of the railcar underframe.

16. The modular top system of claim 15, further comprising a plurality of gussets, wherein:

each trough of the one or more troughs comprises one or more angled floor sheets, each floor sheet of the one or more angled floor sheets comprising:

a pair of sloped sides; and a horizontal bottom; and each gusset of the plurality of gussets is coupled to at least one trough of the one or more troughs and configured to support a sloped side of the pair of sloped sides of the at least one trough.

17. The modular top system of claim 16, further comprising a plurality of support members, wherein:

each trough of the one or more troughs is positioned between a pair of adjacent support members of the plurality of support members; and each gusset of the plurality of gussets extends between a support member of the plurality of support members and a sloped side of the pair of sloped sides of a trough of the one or more troughs.

18. The modular top system of claim 17, wherein:

a side sill of the pair of side sill comprises a scalloped upper edge defining one or more indentations;

each support member of the plurality of support members extends in a transverse direction between the pair of side sills; and each indentation of the one or more indentations is associated with a trough of the one or more troughs, wherein a position of a center of the indentation along the length of the modular top system generally corresponds to a position of a center of the associated trough along the length of the modular top system.

* * * * *